US005110116A

United States Patent [19]

Kobler et al.

[11] Patent Number: 5,110,116

[45] Date of Patent: May 5, 1992

[54] APPARATUS TO REMOVE FOLDED PRODUCTS, PARTICULARLY FOLDED NEWSPAPER PRODUCTS OR NEWSPAPER SECTIONS, FROM A CARRIER STRUCTURE, AND METHOD OF SUCH REMOVAL

[75] Inventors: Ingo Kobler, Anhausen; Godber Petersen, Augsburg, both of Fed. Rep. of Germany

[73] Assignee: MAN Roland Druckmaschinen AG, Offenbach am Main, Fed. Rep. of Germany

[21] Appl. No.: 519,119

[22] Filed: May 4, 1990

[30] Foreign Application Priority Data

May 10, 1989 [DE] Fed. Rep. of Germany ..... 3915228

[51] Int. Cl.[5] ..... B65H 5/02

[52] U.S. Cl. ..... 271/277; 271/162; 271/186; 271/201; 271/204; 271/214; 271/279; 270/58; 270/54; 414/788.3

[58] Field of Search ..... 271/204, 206, 275, 277, 271/201, 162, 186, 214, 279; 270/54–58; 414/788.3, 791.2, 791.3

[56] References Cited

U.S. PATENT DOCUMENTS 4,408,755 10/1983 Meier ..... 270/57 X
4,565,130 1/1986 Leu ..... 270/58 X
4,807,865 2/1989 Köbler et al. .
4,828,242 5/1989 Kobler et al. .
4,840,365 6/1989 Köbler et al. .
4,871,159 10/1989 Petersen .
4,948,109 8/1990 Peterson ..... 270/57 X
4,982,944 1/1991 Eberle ..... 271/204
5,007,629 4/1991 Eberle et al. ..... 271/277

FOREIGN PATENT DOCUMENTS 620517 10/1935 Fed. Rep. of Germany .

*Primary Examiner*—Robert P. Olszewski
*Assistant Examiner*—Boris Milef
*Attorney, Agent, or Firm*—Frishauf, Holtz, Goodman & Woodward

[57] ABSTRACT

Folded products, supplied in dual-comb like interdigited form are transported by a transport chain system (75) carrying grippers (84, 85) in a vertical direction to form a vertical stack. Grippers engage alternate products about their fold line, and hold the interdigited intermediate sheets therebetween. The transport system and a carrier structure are placed in relative positions to permit the grippers of the transport system to pick up the products (1, 2) at the fold line and, after reorienting the products, to place them in a vertical stack on a support (96, 110), a cam track (88) opening the grippers on the transport system (75) as the grippers pass about a vertically movable deflection wheel (97) to release the products. The deflection wheel moves upwardly as the stack grows. The products are originally supplied in open V-shaped form, and one group (2) of the products is gripped at the open edges of the V, as well as at the fold lines; as so gripped it is inverted and transported to fit, roof-like, over the other products (1) which retain their open V position, for example by guiding a pair of clamping strips or rails (35, 35') with grippers (40, 41) thereon in a circular path.

21 Claims, 24 Drawing Sheets

APPARATUS TO REMOVE FOLDED PRODUCTS, PARTICULARLY FOLDED NEWSPAPER PRODUCTS OR NEWSPAPER SECTIONS, FROM A CARRIER STRUCTURE, AND METHOD OF SUCH REMOVAL

Reference to related patents, assigned to the assignee of the present applications, the disclosures of which are hereby incorporated by reference:

Kobler et al U.S. Pat No. 4,807,865,

Petersen U.S. Pat. No. 4,871,159,

Kobler et al U.S. Pat No. 4,828,242.

Reference to related application, assigned to the assignee of the present application: U.S. Ser. No. 07/518,806, filed May 4, 1990, Kobler et al (claiming priority German P 39 15 195.6 of May 10, 1089.

Reference to related patent, by the inventor hereof and assigned to the assignee of this application Kobler and Petersen U.S. Pat. No. 4,840,365.

FIELD OF THE INVENTION

The present invention relates to the handling of printed subject matter after it has been folded, and especially to the handling of folded newspaper product, retained in a carrier structure, removal of such folded products, and then stacking them in vertical stacks which are stable.

BACKGROUND

The referenced patents, the disclosures of which are hereby incorporated by reference, namely U.S. Pat. Nos. 4,807,865, 4,871,159 and 4,828,242, as well as U.S. Pat. No. 4,840,365, describe arrangements for placing, retaining and/or storing folded products in V-shape, open at the free ends of the V. The folded products can be removed from the carrier structures, for example for storage, for mixing of folded products, or for placement of inserts therein.

Flat storage of folded products in stacks will result in instability of the stack since, at the fold line or fold edge, the products will be thicker than at the unfolded or open ends or edges. It is, therefore, necessary, to stabilize such a stack. If vertically stacked folded products are to be subsequently processed, for example to remove therefrom or place therein inserts such as advertising sheets, special newspaper sections, or even small articles, re-opening of the folded products is required. Re-opening of folded products is difficult; it has been proposed to use opening-cylinders or to provide fold-over flaps, engaged between the folds to permit easy openings. Such fold-over flaps, however, should be removed at a later time and, further, waste paper.

THE INVENTION

It is an object to provide a method and system to handle folded products on a carrier structure in which the products are interdigited in comb-like fashion, and located that fold edges occur at respectively opposite sides of alternately sequentially positioned products, to remove such folded products and stack them in a reliable, stable stack. Additionally, the products should be so handled that they can be readily opened, that is, that the V-configuration with access between the respective product elements forming the sides of the V is retained, to thereby avoid the necessity of using a fold-over flap or other complex opening arrangements.

Briefly, a transport system is provided which is located adjacent the carrier structure, which retains the folded products in alternately placed, interdigited V position. The transport system has grippers thereon engageable about the fold lines of alternate products to grip around and somewhat over the outer sides of the folded products and thereby also grip the sheet portions of the adjacent products which are between the respective side elements of the folded products. When the folded products have been gripped in the grippers, the carrier structure and the transport system are moved relatively away from each other so that the grippers will hold the folded products at the edges of alternate ones, with the intermediate ones hanging therebetween, but gripped by the grippers through the alternate products. The transport system is then guided in an essentially vertical path and the folded products are oriented in a horizontal direction so that they will come to lie above each other, in a vertical stack, with the folded edges or fold lines of alternate products oriented 180° with respect to each other. The gripper means are then released, for example under control of a suitable control element such as a cam, thereby leaving the stack of folded products which is stable since alternate products have their fold lines at opposite sides.

In accordance with a feature of the invention, the folded products are first placed into the carrier structure, and interengaged in interdigited form.

After the stack has been formed, the folded products can readily be opened by slightly pulling them apart; alternatively, an arrangement could be provided which includes a guide element to open the folded products for later regripping thereof by a gripper system, which may be the same one which originally transported the products to the stack, that is, to then remove the folded products from the stack.

DRAWINGS

DETAILED DESCRIPTION

Figure 4:
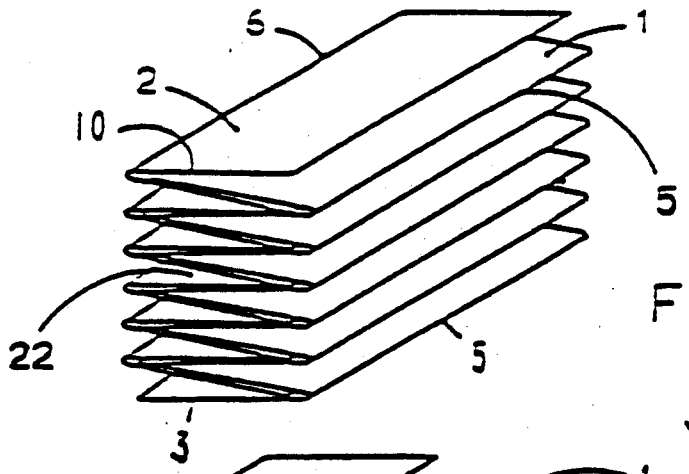
FIGS. 1–4 are schematic isometric views of the formation of a stack starting with two folded products.
Figure 3:
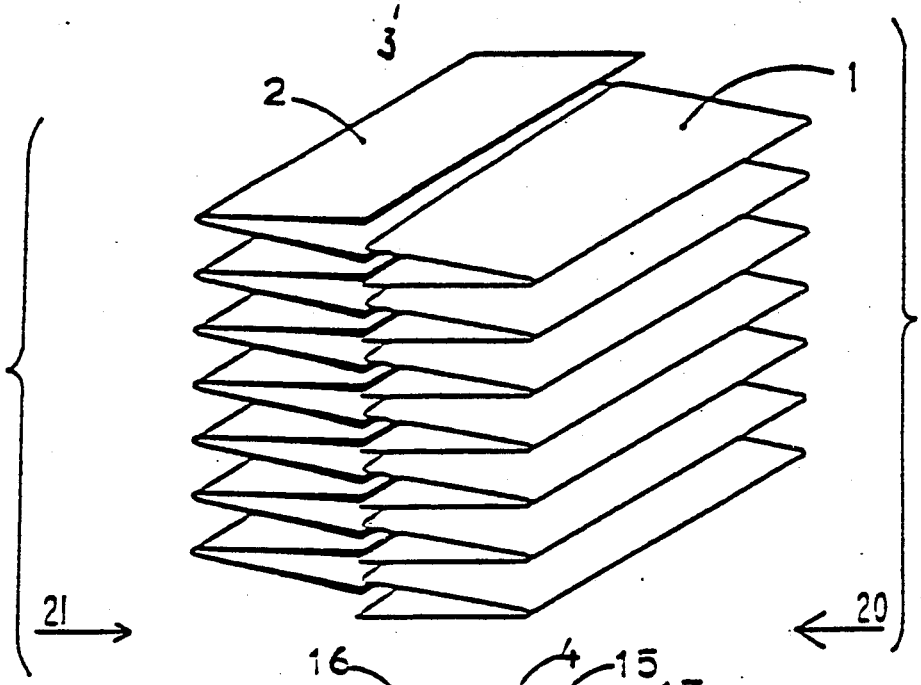

Referring first to FIGS. 1-4;

A folded product, typically a printed product 1, 2 which may be formed of a plurality of individual elements, for example a section or group of sections of a newspaper, is folded at lines 3 and 4 and further, at right angles thereto, at lines 5 and 6, to form respective fold lines 3, 4; 5, 6. Usually, the fold lines 3, 4 are termed the "longitudinal fold" and the fold lines 5, 6 the "cross fold". This, then, leaves individual open sides of the products at 7, 8 and 9, 10, as well as at 7', 8', 9', 10'. The folded products 1, 2 have different heights at the corners 11, 12, 13, 14 and 15-18 due to the different formation of the sides, folded at the edges 3, 5 and 4, 6 and open at the edges 7, 7', 8, 8' and 9, 9', 10, 10'. Each one of the portions or sides 1*a*, 1*b*, 2*a*, 2*b* of the folded products may be formed by a multiplicity of individual sheet elements. If these folded products 1, 2 are stacked in the alignment shown in FIG. 1, the difference in height between the folded edges 3, 5; 4, 6 and the unfolded edges 7, 7', 8, 8'; 9, 9', 10, 10' will cause the stack to become tippy and unstable when it reaches a certain height.

Figure 2:
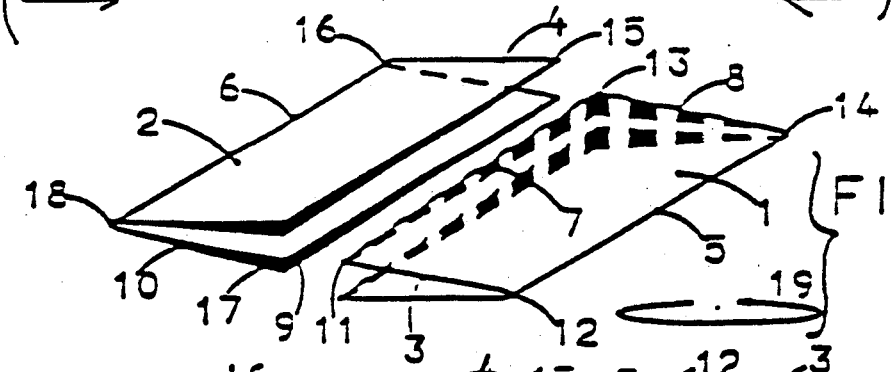
Figure 1:
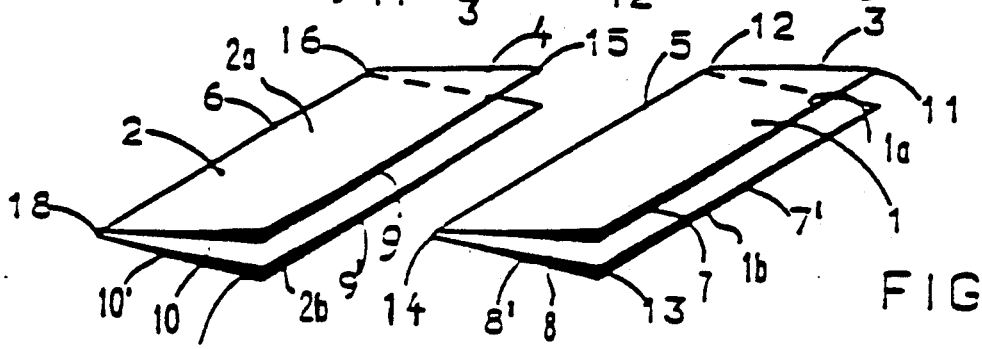

FIG. 2 illustrates that, after rotating product 1 as shown schematically by the arrow 19 about 180°, and subsequent matching of the folded edges and open edges above each other, height or thickness differences will be compensated.

Upon rotating, thus, each alternate or second or other folded product in the direction of the arrow 19, the sheets can further be inserted as shown schematically by arrows 20, 21 (FIG. 3) into each other, in zig-zag shape. Thus, the result will be a stable stack 22, as seen in FIG. 4. This stack 22 further permits ready access at a later time to remove sheets from the closed edges 3, 5 or 4, 6, with the result that the folded products 1, 2 will open from the middle on out.

FIGS. 5 to 18 described particularly desirable structures which can be used with the system and method of the present invention to form the stack 22, by placing, the folded products 1, 2 in dual-comb, interdigited arrangement as seen in FIG. 4, the folded products 1, 2 being supplied from zig-zag carrier structure 23 and 2340 . The folded products 1 are open towards the top in V-shape, located in the carrier structure 23. Folded products 2 are then gripped, and tipped over so that they will be rotated 180° after removal from a carrier structure 23', to be then placed on the folded products 1 still in the carrier structure 23, in dual-comb-like, or interdigited form. The carrier structures themselves, suitable for use with the system of the present application, are known and described, for example, in the reference patent assigned to the assignee of the present application, Kobler et al U.S. Pat. No. 4,840,365.

Figure 5:
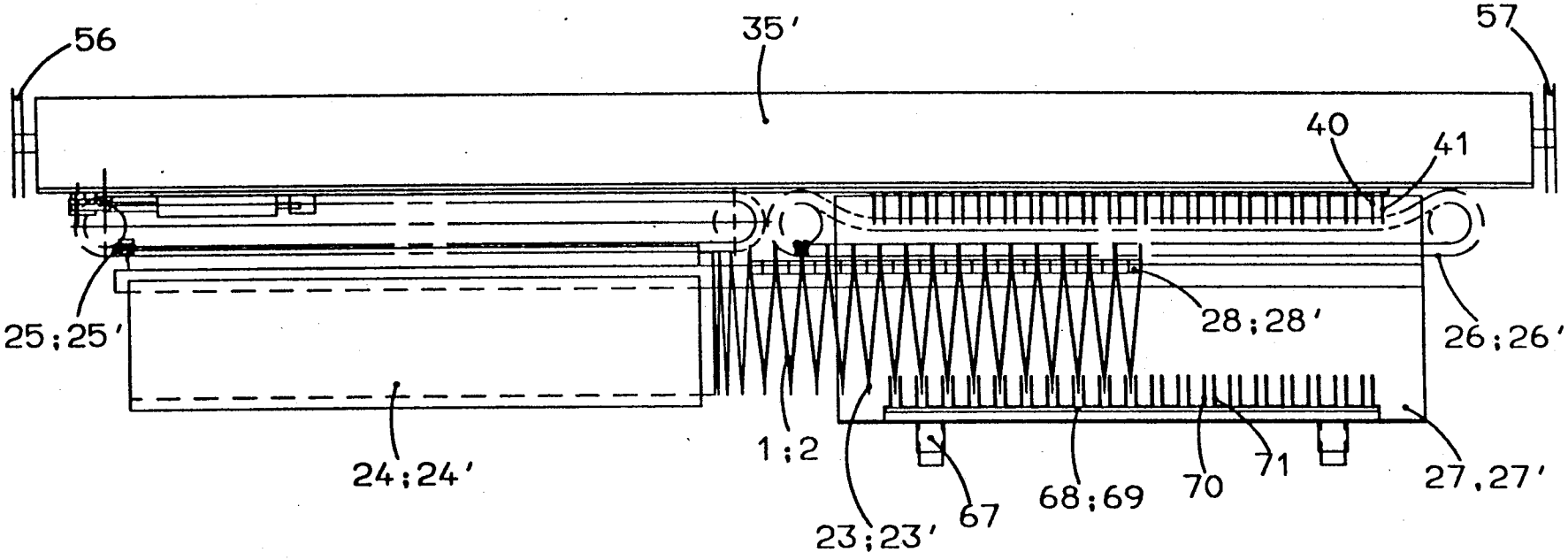
FIG. 5 is a side view of an apparatus supplying folded products.
Figure 6:
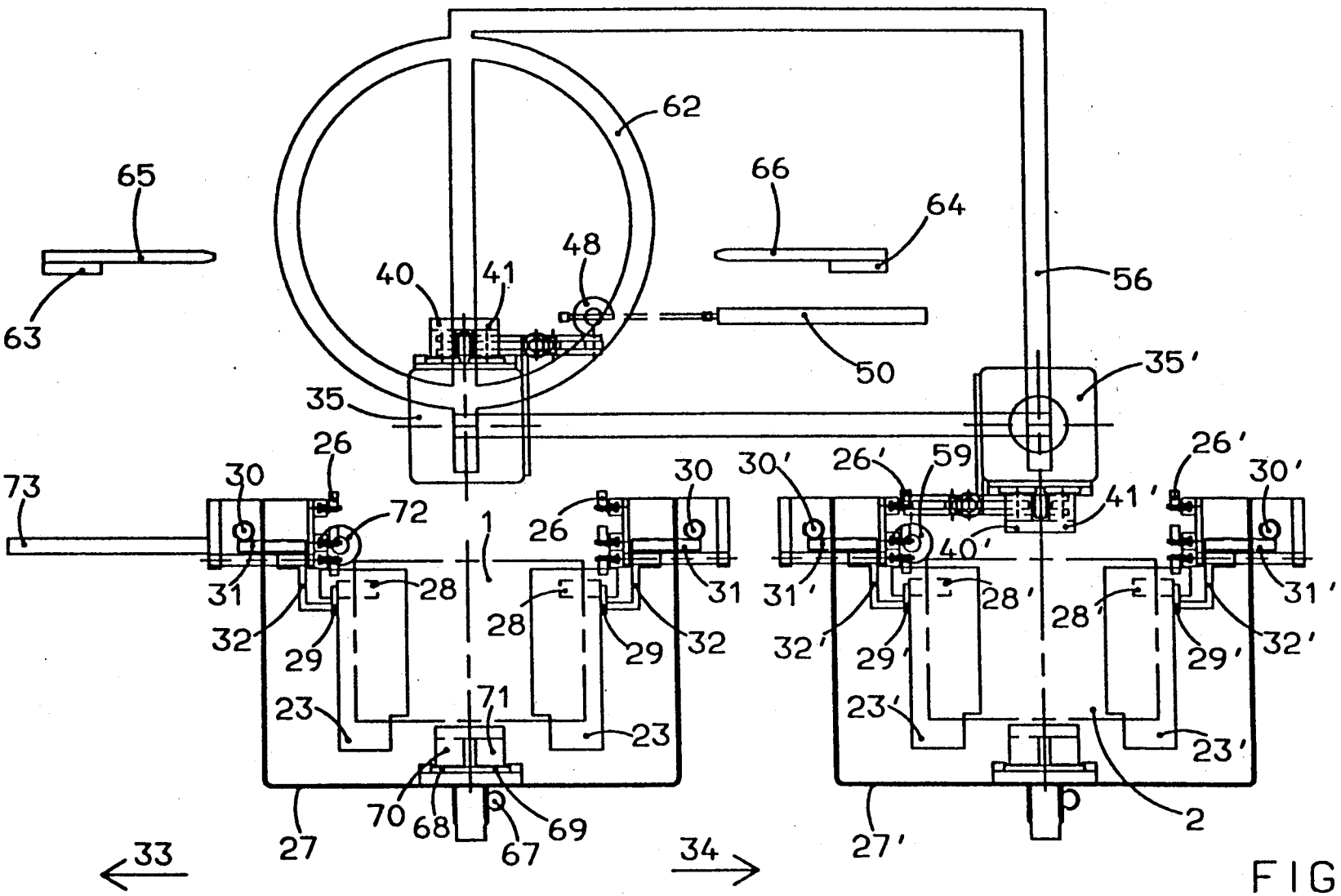
FIG. 6 is an end view of the apparatus supplying folded products and a general system to invert one of the folded products so that they can be placed over the other with the folded edges at opposite positions.

Referring first to FIGS. 5 and 6, which, highly schematically, illustrate an arrangement to transfer folded products 2 from a carrier structure 23' (right side of FIG. 6) and to place them, in 180° inverted form, interdigited, within the folded products 1, which are in the carrier 23 (left side of FIG. 6).

Initially, the carrier structures 23, 23', which are zig-zag structures, are located in storage cassettes 24, 24'. Drive systems 25, 25', 26, 26', respectively, pull out the carrier structures 23, 23' and place them in cassette-formed carriers 27, 27'. Tongues 28, 28' located on the carrier structures 23, 23' spread the folded products apart in upwardly opening V-shape as the carrier structures 23, 23' are pulled apart. These tongues may, for example, be resilient, essentially horizontally extending V-elements, as described in the referenced U.S. Pat. No. 4,840,365. The carrier structures 23, 23' are supported on rails 29, 29' and can be laterally spread by drives 30, 30', and racks 31, 31', coupled to suitable holders 32, 32' for lateral movement in the direction of the arrows 33, 34.

In accordance with a feature of the present invention, the carrier structures 23, 23' are located beneath clamping strips or clamping rails 35, 35'.

Figure 10:
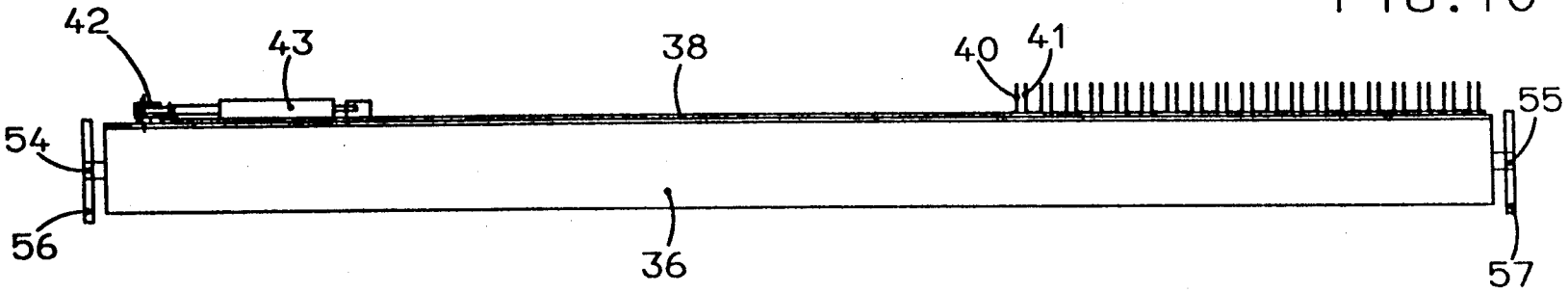
FIG. 10 is a side view of the gripper system.
Figure 9:
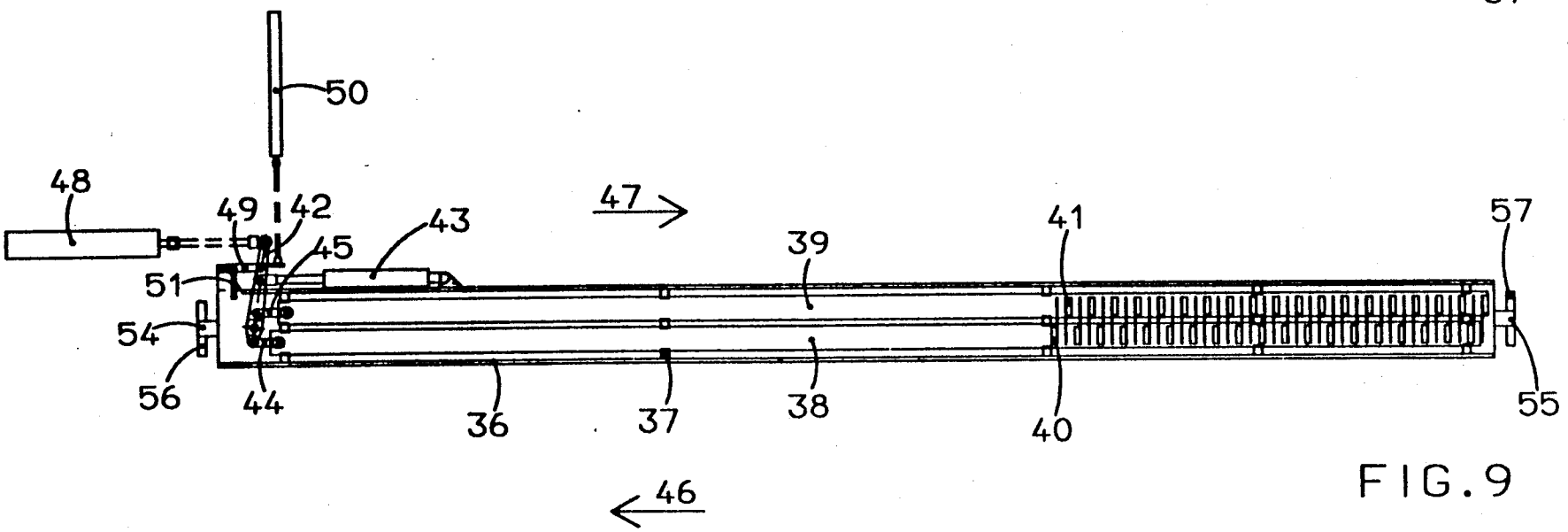
FIG. 9 is a top view illustrating details of a gripper system.

The operation of the clamping strips or rails is best seen when considering FIGS. 9-12. As illustrated in FIGS. 9 and 10, the clamping strips or rails 35, 35' include a support, or carrier rail or rod 36 which carries rail elements 38, 39, suitable guided for example by guide blocks 37. Grippers 40, 41 are located on the rail elements 38, 39. A pivot lever 42, biassed by a spring 43, can be operated by levers 44, 45 to shift the rail elements 38, 39 in opposite directions with respect to each other, as shown by arrows 46, 47 in FIG. 9. This opens the grippers 40, 41. Spring 43, for example, is a gas spring.

Figure 11:
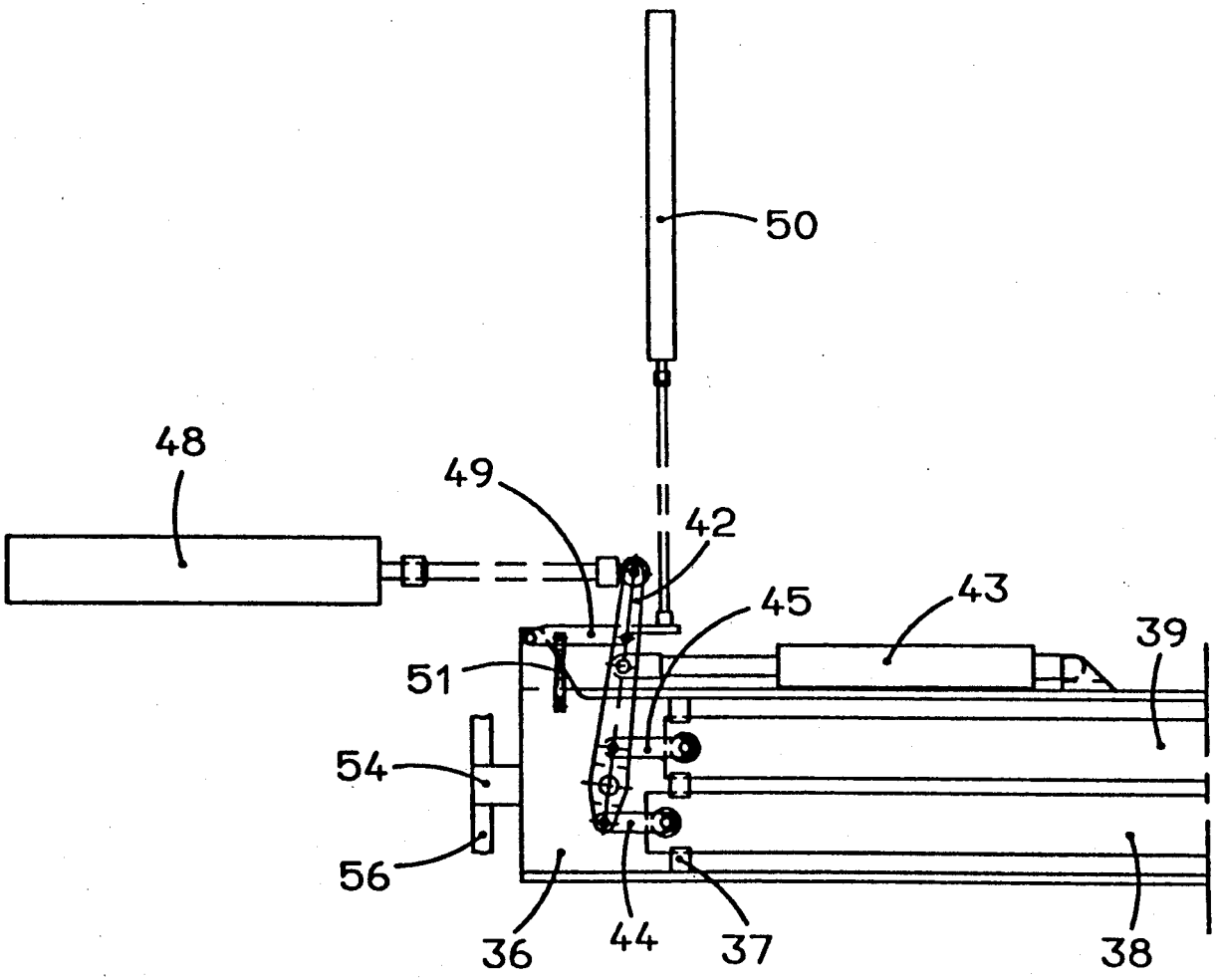
FIG. 11 is a detailed view of the operating portion for the gripper system of FIGS. 9 and 10.

FIG. 11 illustrates an enlarged portion of FIG. 9, and shows that the pivot lever 42 is positioned by a fixed pneumatic cylinder 48, the piston of which is placed as shown in FIG. 11 counter the force of the spring 43. Spring 43 is secured to the rail 35. In this position, the pivot lever can be locked by a locking bolt 49, moved counter the force of a spring 51 into the position shown in FIG. 11. After the pneumatic piston 48 has withdrawn, the pivot lever 42 remains in position. Likewise, the pneumatic piston 50 will not change its position since the spring 43 presses the lever 42 counter the locking lever 49.

Figure 12:
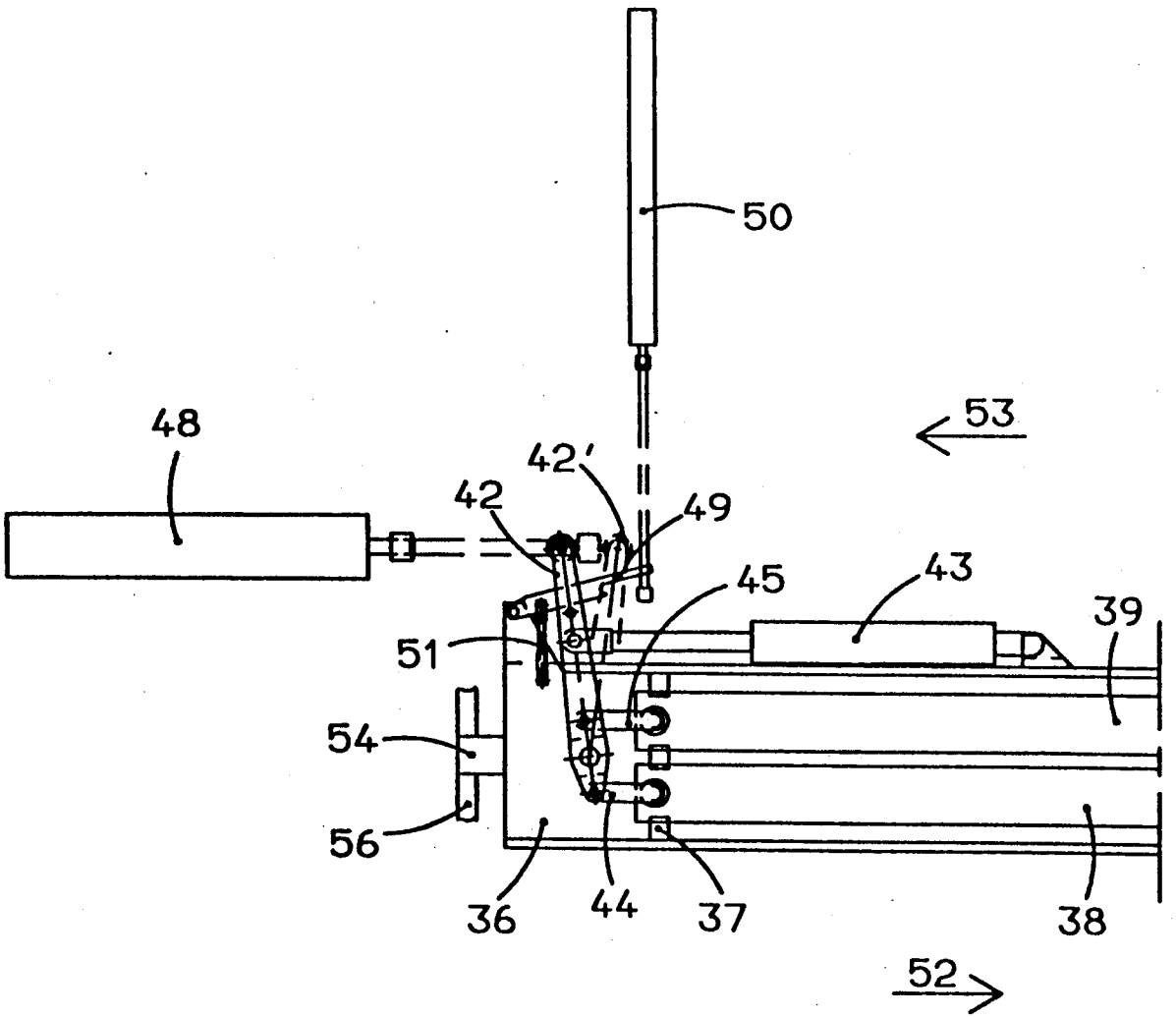
FIG. 12 illustrates the system of FIG. 11 in a different operating position.

FIG. 12 illustrates the same mechanism at a subsequent position, in which the pneumatic piston 48 is engaged against the pivot lever 42 and presses it into the position 42' to release the latch 49 and press the spring 51 into the position shown in FIG. 2. This permits the spring 43, after withdrawal of piston 48, to move the rail elements 38, 39 in the direction of the arrows 52, 53 counter each other after the piston 48 has been withdrawn. The gripper elements 40, 41 are then pressed against each other to grip any articles therebetween.

Consequently, closing of the grippers 40, 41 occurs under the force of the spring 43. This permits holding folded sheet elements or single sheets between the grippers 40, 41 while permitting the rails 35, 35' as a whole to be driven by drive pins 54, 55, operating in suitable guides—not further shown in FIGS. 11 and 12—without requiring carrying-along of the pneumatic pistons 48, 50. These pistons are located in fixed position, for example on a frame—not shown—of the apparatus. They do not move with the rails 35, 35', which greatly simplifies the structure and substantially decreases the weight of the structural components which must be moved.

Figure 7:
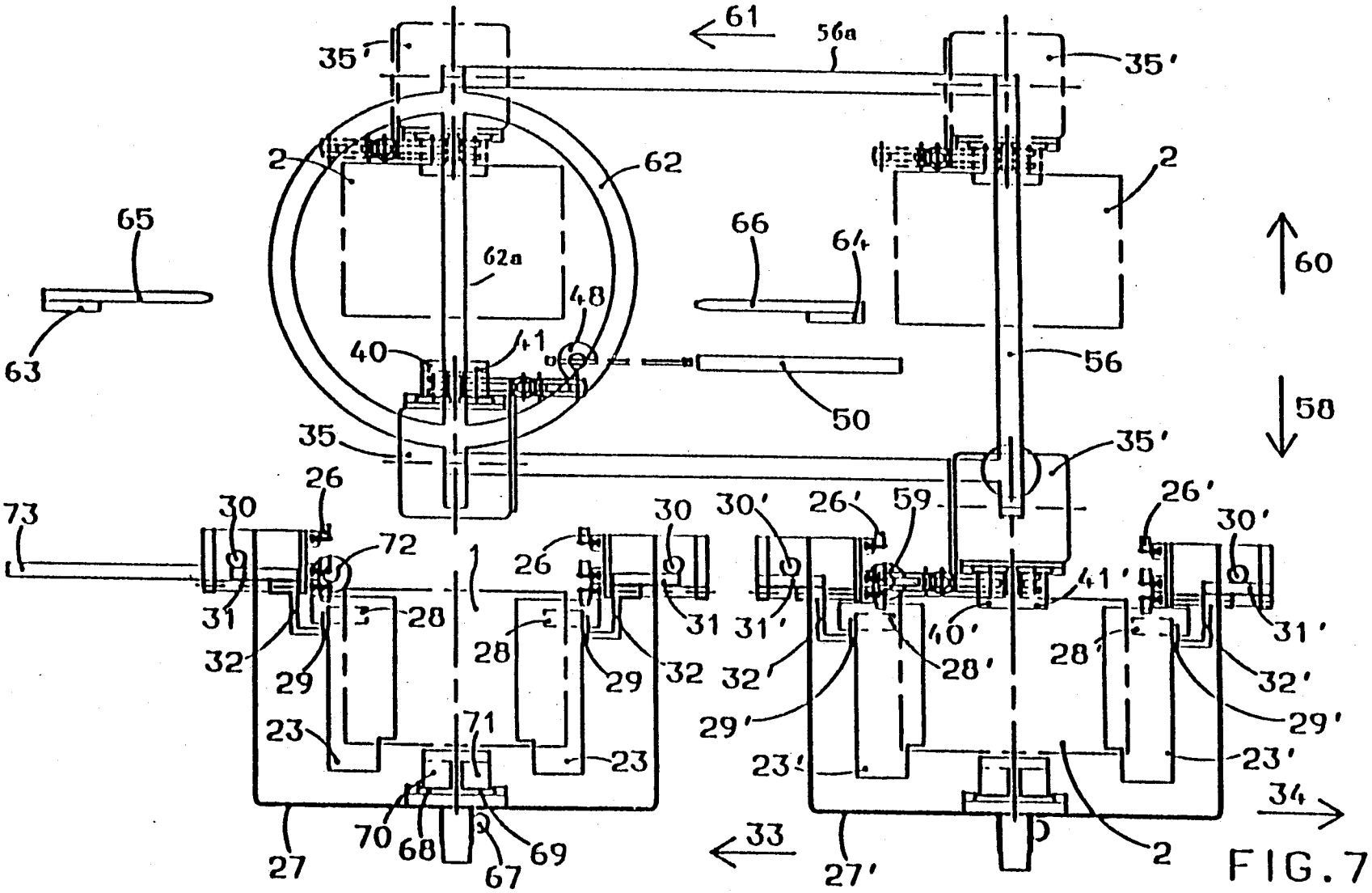
FIG. 7 is a view similar to FIG. 6, and illustrating operation of the apparatus.
Figure 8:
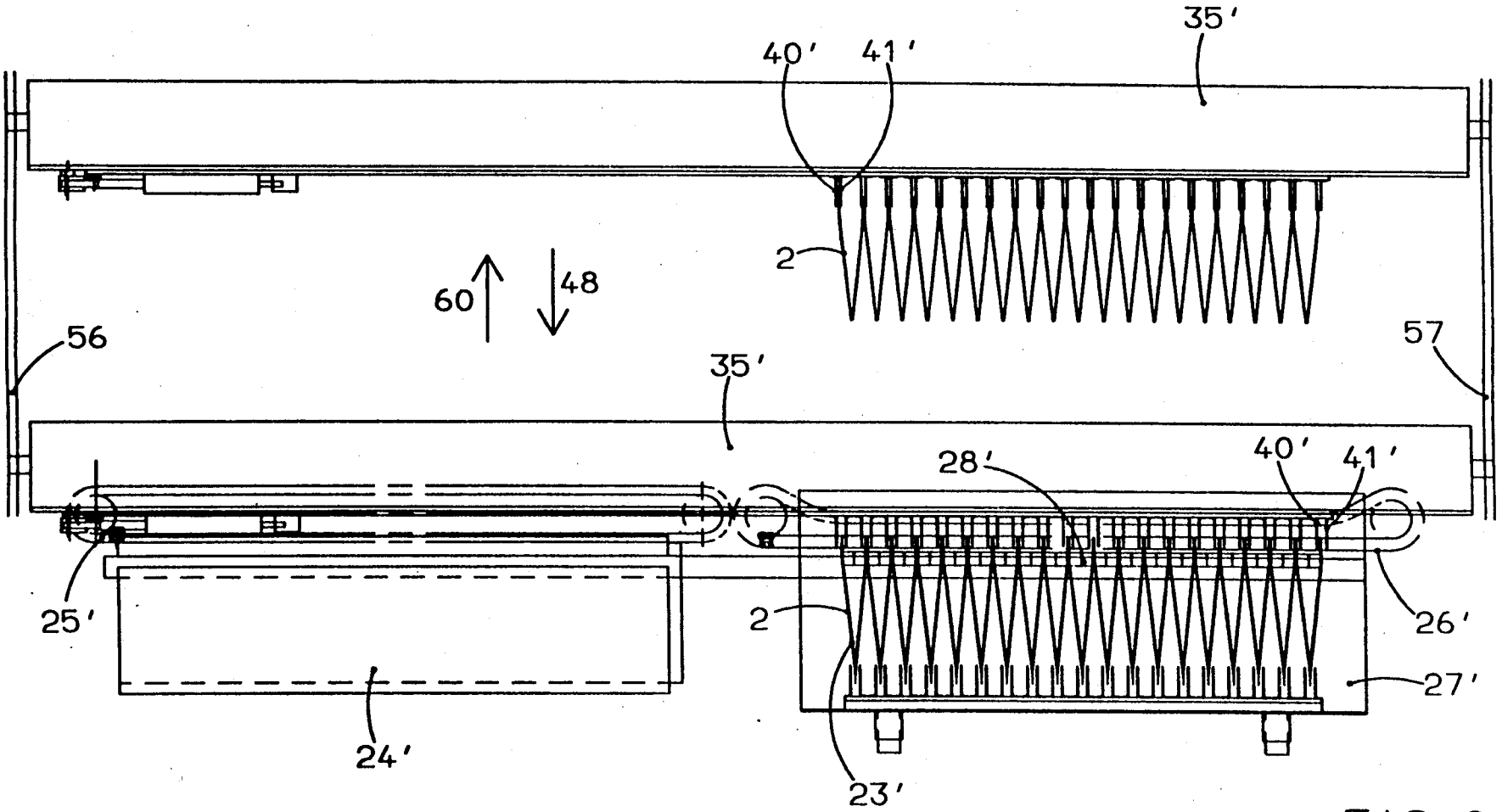
FIG. 8 is a view similar to FIG. 5, and illustrating a step in the operation of the apparatus.

Referring against to FIGS. 5 and 6 and further to FIGS. 7 and 8, one of the clamping rails or strips is moved from a rest or waiting position, shown in FIGS. 5 and 6 in the direction of the arrow 58 (FIG. 7) when its grippers 40', 41' have been opened. The particular rail element shown in FIGS. 5–8 is the rail element 35'.

Upon downward movement of the rail element 35', the open grippers 40', 41' engage into the carrier element 23' and grip the V-shaped folded products, held open in this position by the tongues 28' when the pneumatic piston 59 (FIG. 7) is operated. Piston 59 corresponds to piston 48, described in connection with FIGS. 9–12. After the grippers 40', 41' are engaged in the carrier structures 23', adjacent product portions, forming adjacent sides *2a, 2b* (FIG. 1) of sequentially placed products are gripped by grippers 40, 40' as they are located in upwardly open V-shaped position and held open by the tongues 28'. The fold line 6 is at the bottom.

The carrier structures 23' are two-part elements and drives 30' are energized to remove the carrier structures 23' from the folded products in the direction of the arrows 33, 34, FIG. 7. This releases the folded products from the tongues 28'.

The rail element 35', with the upwardly open folded products 2 hanging thereon, is moved upwardly in the direction of the arrow 60 along guide tracks 56, 57 (FIGS. 7, 8) and then moved in the direction of the arrow 61 in the upper left position as shown in FIG. 7 in a guide track portion 56*a*. In this position, the rail element 35' with the folded products 2, will be located directly above the storage or holding structure 23 in which the folded products 1 are located, in upwardly V-shaped position, under control of the tongues 28 secured to the carrier structures 23. A second clamping strip or rail 35 is located beneath the strip or rail 35'. It is temporarily placed there in a waiting or holding position. Both the strips or rails 35, 35', as best seen FIG. 7, are transferred to or located in a ring-shaped track or guide arrangement 62. The guide arrangement or track 62 includes a central diametrically placed guide track 62*a*. When the clamping strip or rail 35' has the position shown in FIG. 7 at the upper left side, the lower strip or rail 35, with its open grippers, can be raised from the waiting position so that the open grippers 40, 41 can grip the folded edge of the folded products 2 hanging on the strip or rail 35' at the upper left side as seen in FIG. 7 from below.

A fixed piston 48 is used in order to release the grippers 40, 41 on the rail 35 so that, then, the grippers 40, 41 can close under spring pressure as described in connection with FIGS. 9–12.

The further sequence of operations is described in connection with FIGS. 13–19. FIG. 14 is similar to FIG. 8 and shows, again, the position of the respective elements and the folded products, but after the products 2 have been gripped both by the grippers 40, 41 of the lower clamping strip or rail 35 while they are still held by the grippers 40', 41' of the upper clamping strip or rail 35'. FIG. 14 further illustrates that each one of the V-formed open folded products 2 is held by a gripper 40, 41 at a fold edge 6 (FIG 1); at the upper side adjacent grippers 40', 41' clamp two side portions *2a, 2b* of adjacent folded products. Thus, with the exception of the outermost left and right folded products 2, each one of the upper grippers 40', 41' holds the immediately adjacent side portions *2a, 2b* of the folded products 2.

Rails 35, 35' then enter opposite portions of the rotary track 6, and upon movement of the clamping strips or rails 35, 35' subsequent to this dual gripping on the rotary or circular track 62 by a suitable reversing drive—not shown—for example electrically or hydraulically or pneumatically powered, the strip or rail 35 will assume the position of the strip or rail 35' and, conversely, the strip or rail 35' will assume the position of the strip or rail 35. The position, thus, after rotation about 180° is seen in FIG. 13.

Figure 13:
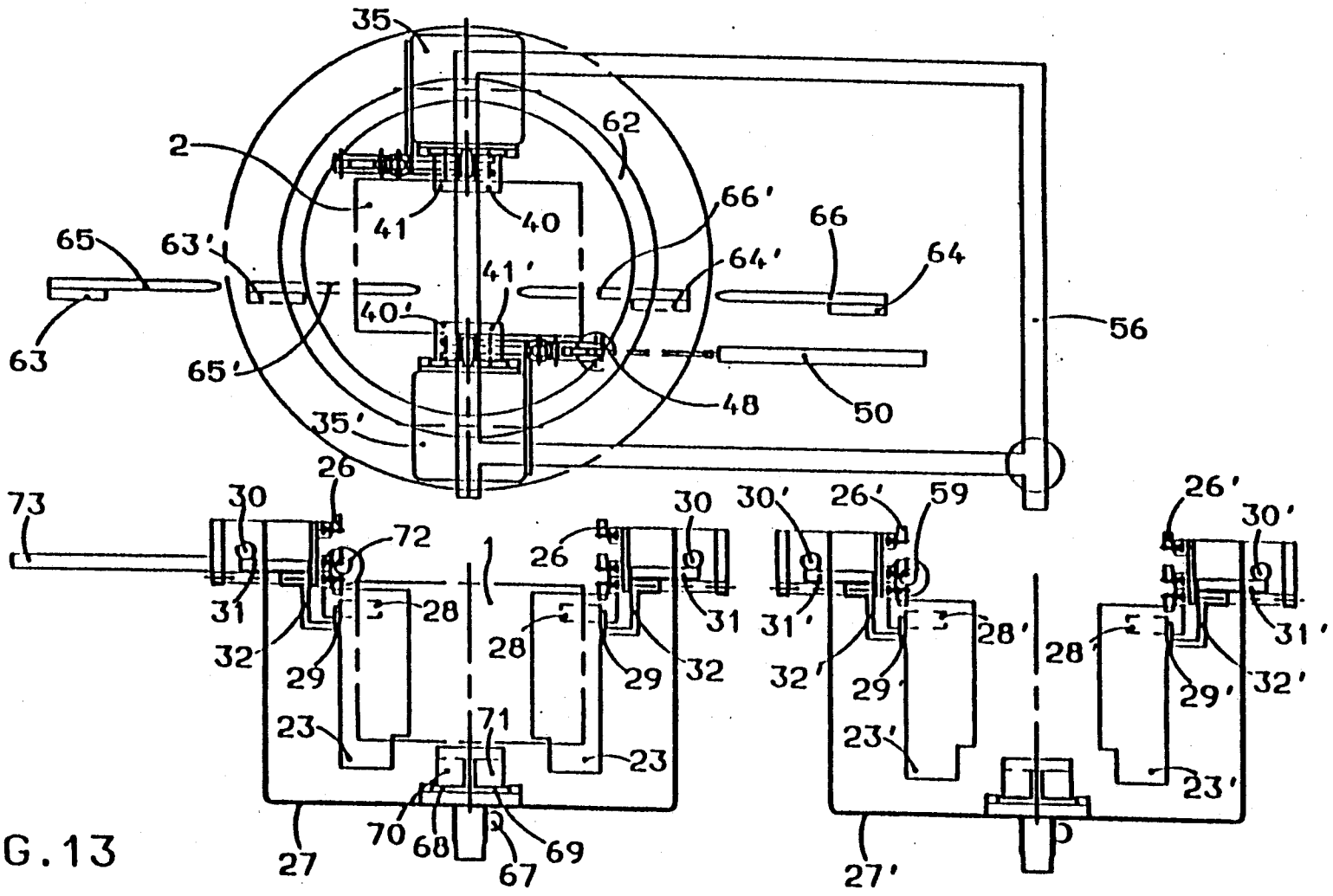
FIG. 13 is a fragmentary schematic view illustrating operation of separating sliders in a first position.
Figure 14:
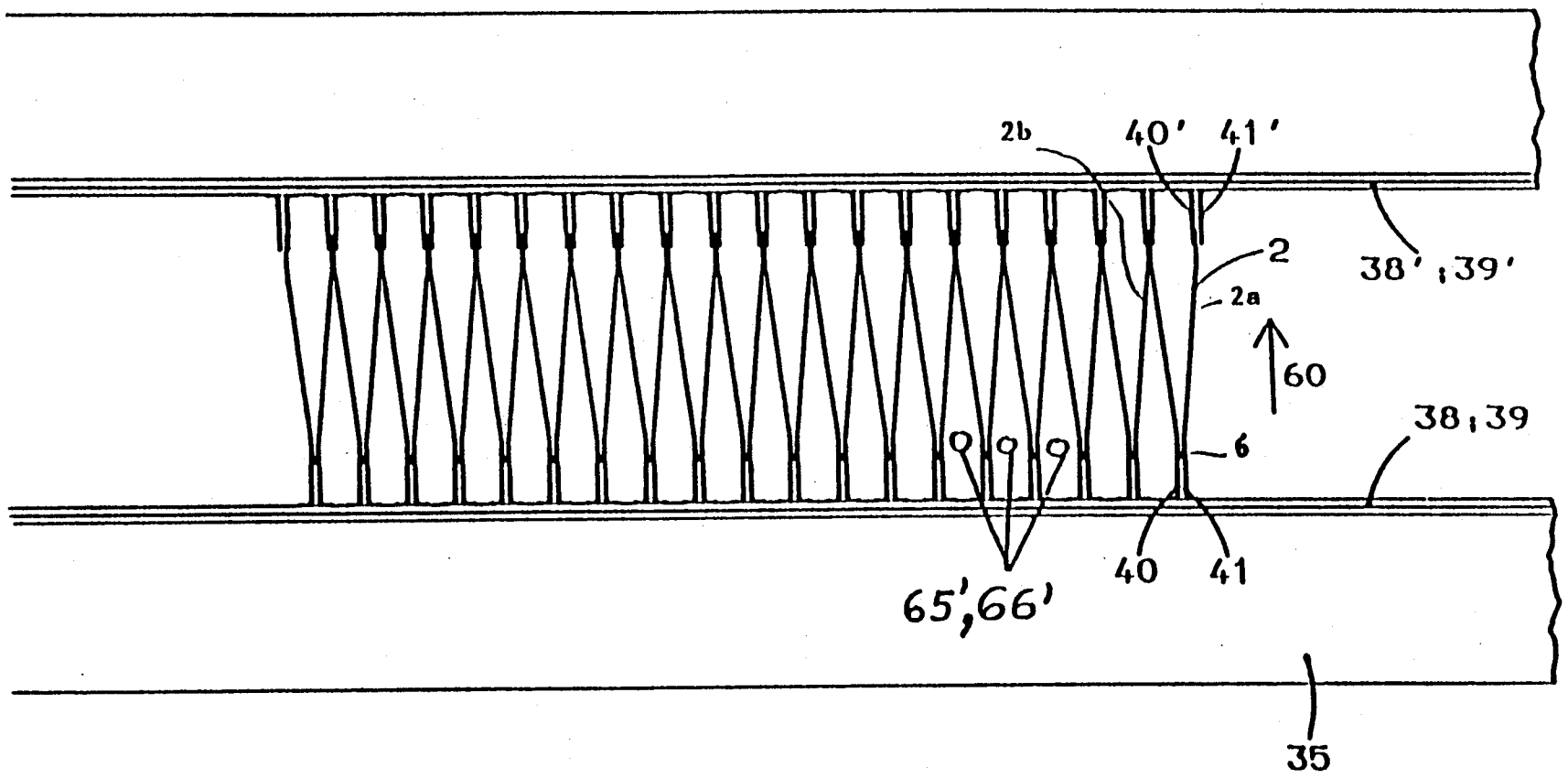
FIG. 14 is a view, turned 90° with respect to FIG. 13, and showing operation of the separating element.
Figure 15:
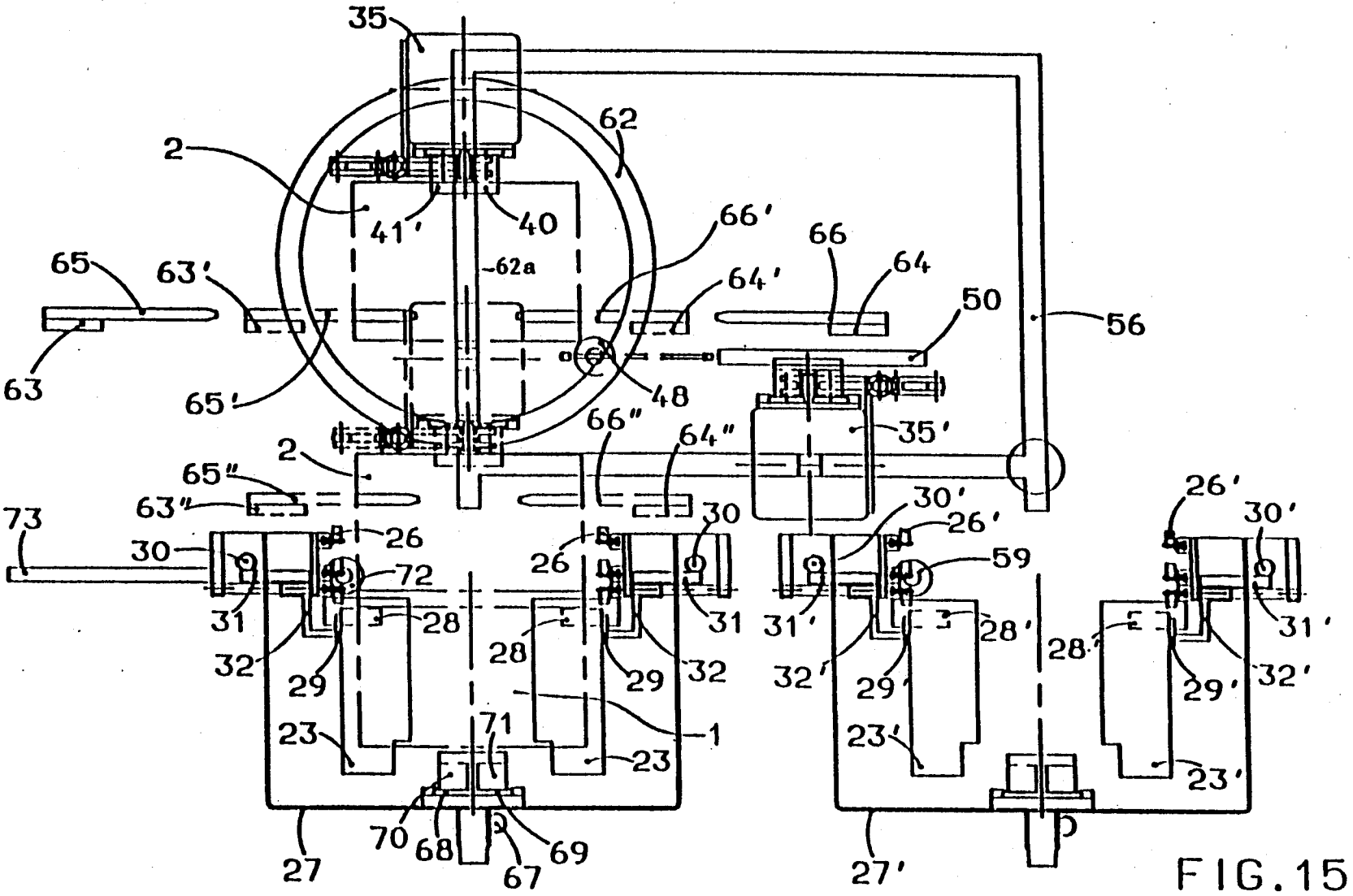
FIG. 15 is a view similar to FIG. 13, with separating elements partially inserted.

In the next operating step or cycle, insert rails 63, 64, having fingers 65, 66 thereon, are shifted from the solid-line position shown in FIG. 13 to the broken-line positions at 63', 64' and 65', 66', respectively. This places the fingers between the still open V-shaped folded products 2, as also shown in FIG. 14, which is a fragmentary side view of FIG. 13, encompassing only that portion which illustrates the folded products 2. As soon as the fingers 65', 66' are inserted between the folded products 2, the folded products can be held, as seen in FIG. 15, in the open position, in which the V shape of the folded products 2 is retained. The now lower grippers 40', 41' are opened by operation of the pistons 48, 50 and the lower clamping strip or rail 35' (FIG. 15) can then be moved laterally for a next operating cycle towards the right in FIG. 15.

Figure 16:
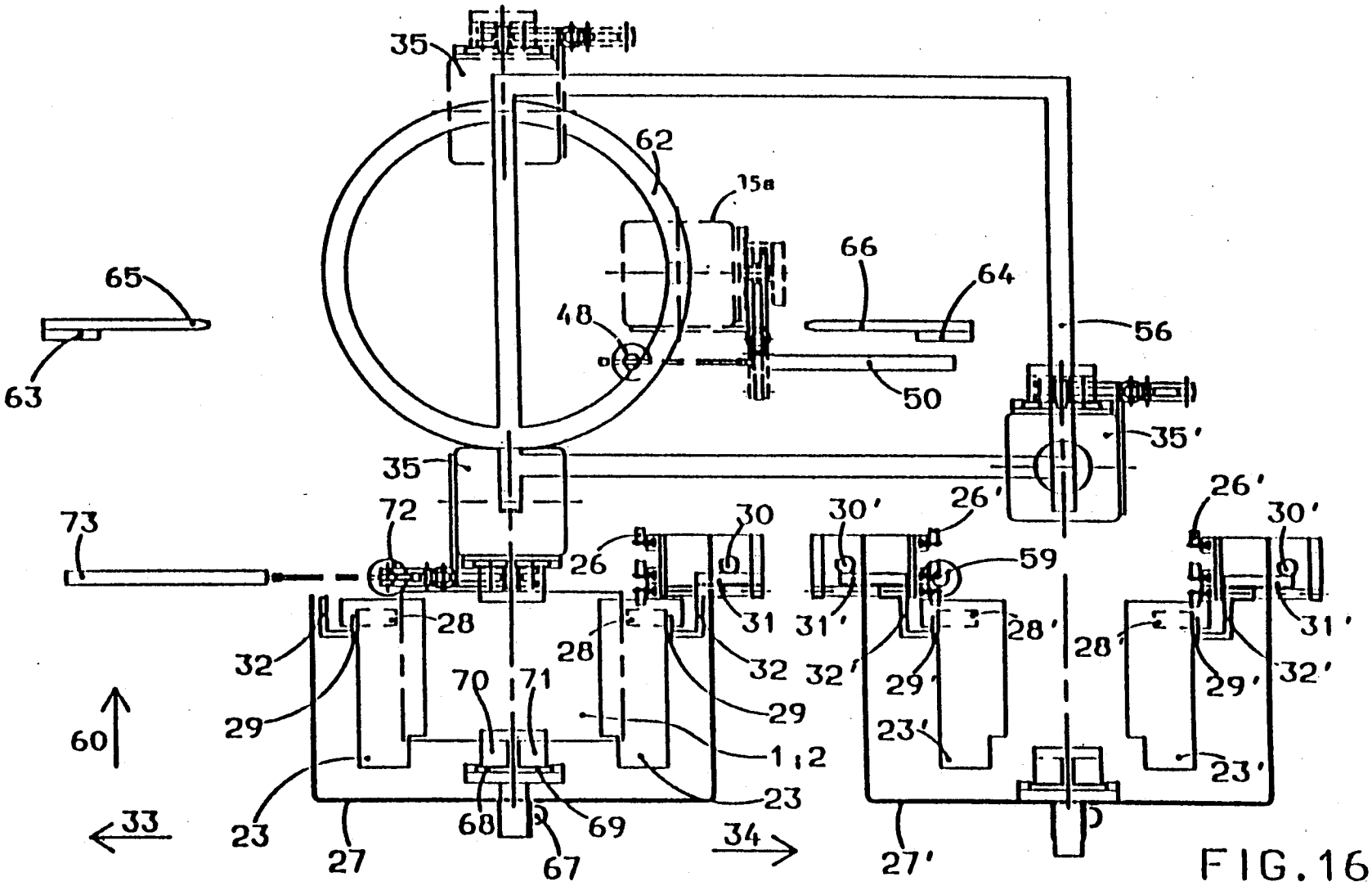
FIG. 16 is a view similar to FIG. 15 when the printed products have been combined.
Figure 17:
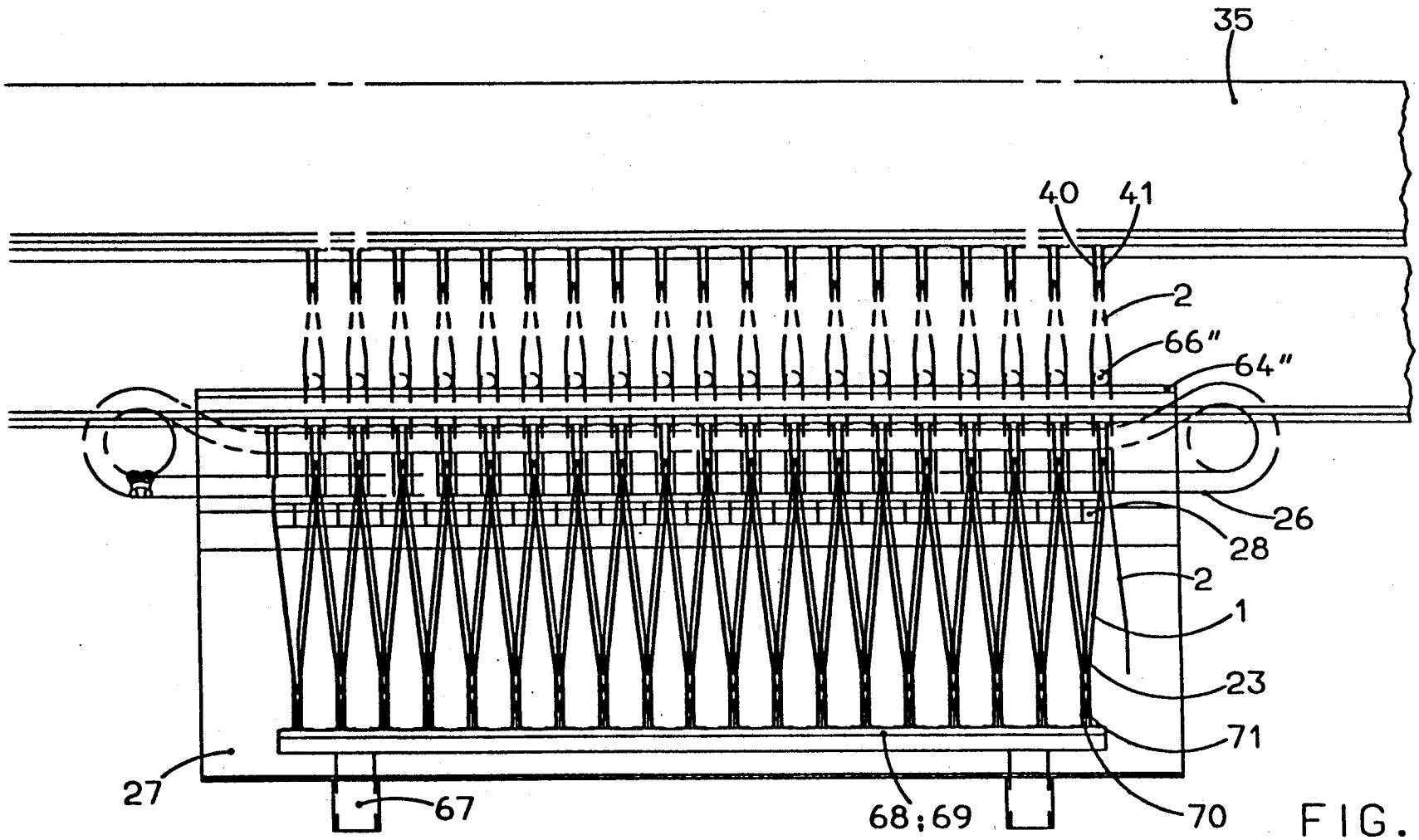
FIG. 17 is a fragmentary view, turned 90° with respect to FIG. 16, showing combination of printed products in interdigited form.

The folded products 2, thus, hang in V-position at their fold edge 6 (FIG. 1), open towards the bottom, being retained on the clamping strip or rail 35 and, upon lowering the clamping strip or rail, can be placed into the folded products 1 held on the carrier structure 23; in other words, they can be interdigited with the folded products 1, as best seen in FIG. 16, which shows the completion insertion operation, by movement of the strip or rail 35 from the upper left, down the central leg 62*a* of the rotary track 62 towards the lower position. FIG. 16 also illustrates the location of the clamping strip or rail 35', in its initial position as shown in FIG. 6. FIGS. 15 and 17 illustrate, in side view, the insertion of the folded products 2 over the folded products 1, from the top down; these figures also show how the folded products 2 are held open by the fingers 65, 66 when placed in the positions 65', 66' and in the positions 65'', 66'', respectively, by the rails in positions 63, 64, 63', 64', 63'', 64'', respectively. These fingers can be withdrawn when the folded products 2 just engage between the side portions or folded product portions of the folded products 1, and then returned to the initial starting position as illustrated in solid lines in FIG. 13.

The upwardly open products 1 are gripped at the bottom. Clamping rail elements 68, 69, having grippers 70, 71, are moved in position in accordance with arrow 60, FIG. 17, to grip the fold or bend line 5 (FIG. 1) of the products 1. The gripper structures, and the rail elements 68, 69 can be identical with or similar to the gripper structure on the gripper rails or strips 35, 35', respectively. The carrier structures 23 with the tongues 28, previously engaged in the products 1, can be pulled outwardly in the direction of the arrows 33, 34 (FIG. 16), for example by means of a drive 30, rack 31, attachment brackets or holders 32 and rails 39, so that the folded products 2 can be completely inserted from above into the folded products 1, like roof elements fitting thereover, as illustrated in FIGS. 16 and 17.

Figure 18:
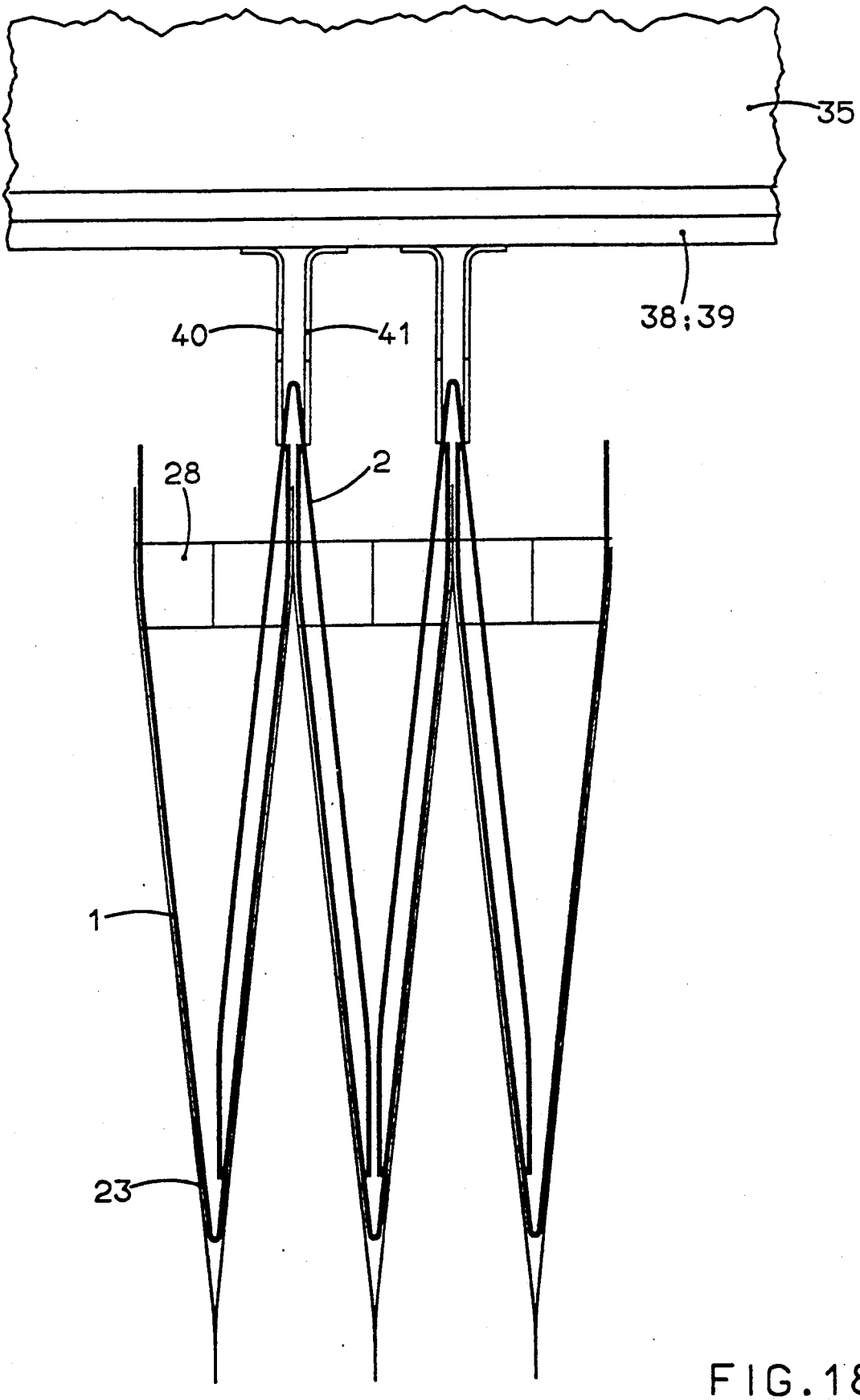
FIG. 18 is an enlarged fragmentary view showing the interdigited combination of printed products.

FIG. 18 is a highly enlarged and expanded view of a few products 1, 2 also shown in FIG. 17, for illustration of the interdigited folded products 1, 2, in which the products 1, 2 are relatively rotated by 180° with respect to each other. These products, then, will form the stack 22 and, when in the position in FIG. 18, can form a particularly stable stack which can be readily further handled or processed.

The inserted products 2, still on the clamping or holding strip or rail 35, are released therefrom by engagement of pneumatic pistons 72, 73 with the linkage movement (FIGS. 9 to 12) so that the grippers 40, 41 thereof are released, as seen in FIG. 16; when open, the grippers are again locked in open position. The rail element 35 then returns into its lower, or waiting position on the circular track or path 62, by movement and guidance over the right half of the circular track 62 (FIG. 10). It is thereby rotated by 180°. Rail element 35 is moved from the upper position in FIG. 16, as shown in broken lines thereof, down through position 35*a*, and the rail 35 will then again be in the position shown in solid lines in FIG. 16, ready for a new operating cycle. There it will be in the waiting position, with the grippers 40, 41 open, and extending upwardly, as seen in FIG. 6.

The switching of rail elements 35 and 35′ between tracks 56, 57, 56*a* and the circuit track 62, as well as its central track 62*a*, can be conventional, as well known when switching movable elements in or on tracks, e.g. from railroad or track guidance technology.

The clamping strip 35′, after having been rotated about 180°, likewise will be brought into the initial position shown in FIG. 6. In that position, the open grippers 40′, 41′ will point downwardly. In a subsequent operating cycle, it can thus receive a new group of folded products from another carrier structure. Comparison of FIGS. 15 and 16 with FIG. 6 shows that, after one transfer cycle of folded products, the clamping strip or rail 35′ is rotated from the position shown in FIGS. 15 and 16 with upwardly directed grippers 40′, 41′ by 180°, in order to reach the position in which the grippers 40′, 41′ point or extend downwardly as shown in FIG. 6.

Figure 19:
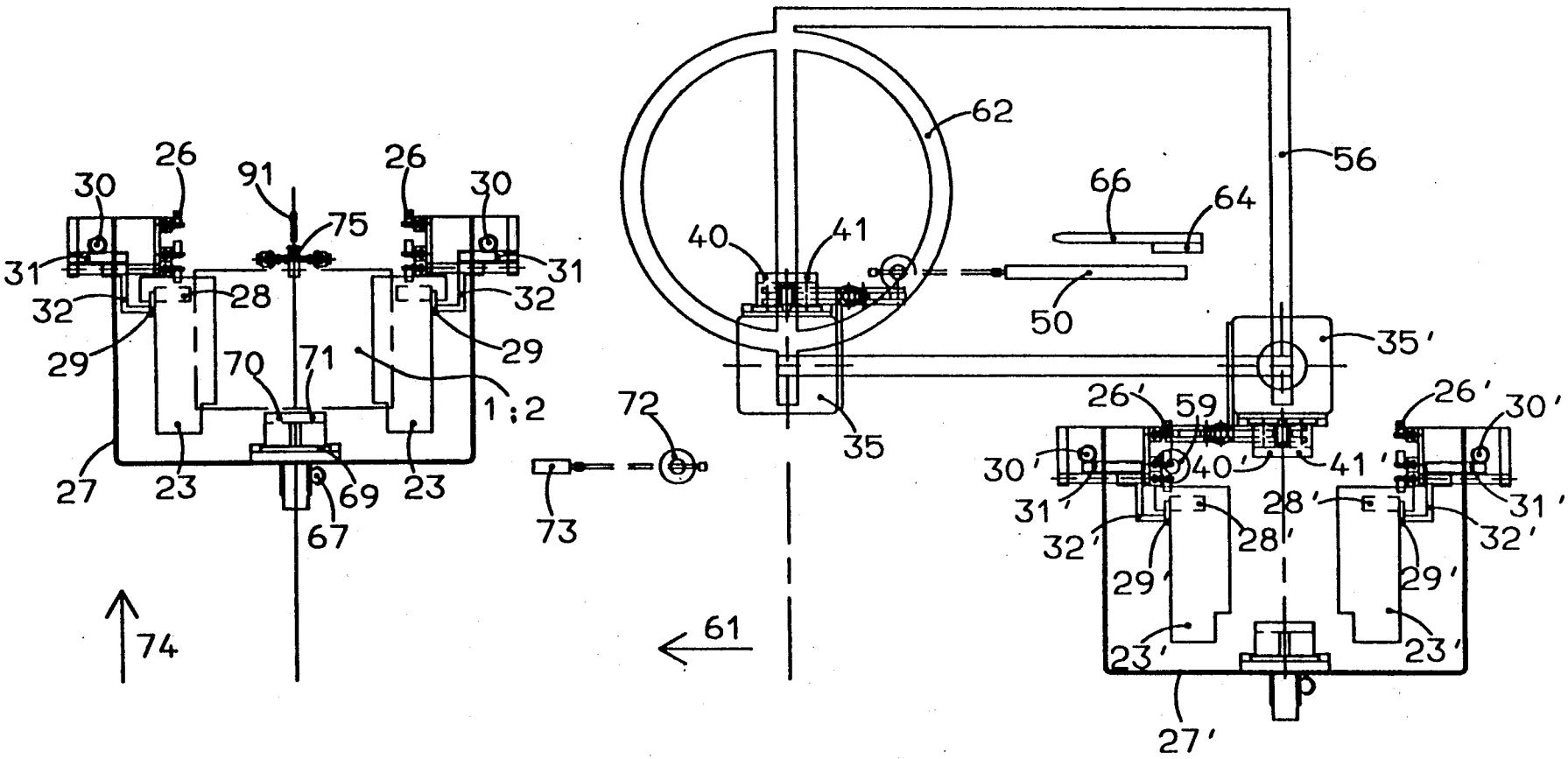
FIG. 19 is an operating diagram, showing movement of structures during steps.
Figure 20:
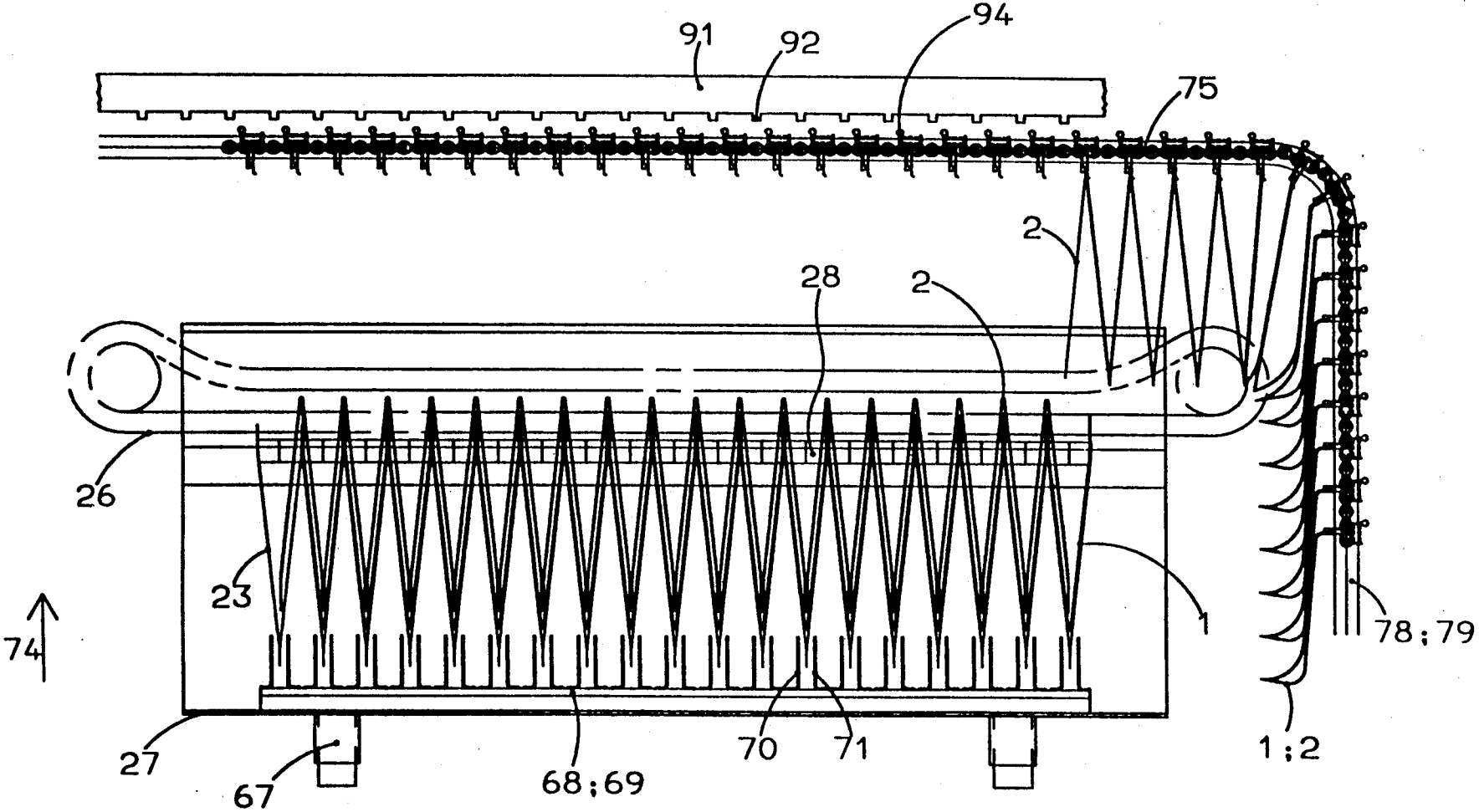
FIG. 20 is a side view illustrating removal of printed products by a removal transport chain.
Figure 23:
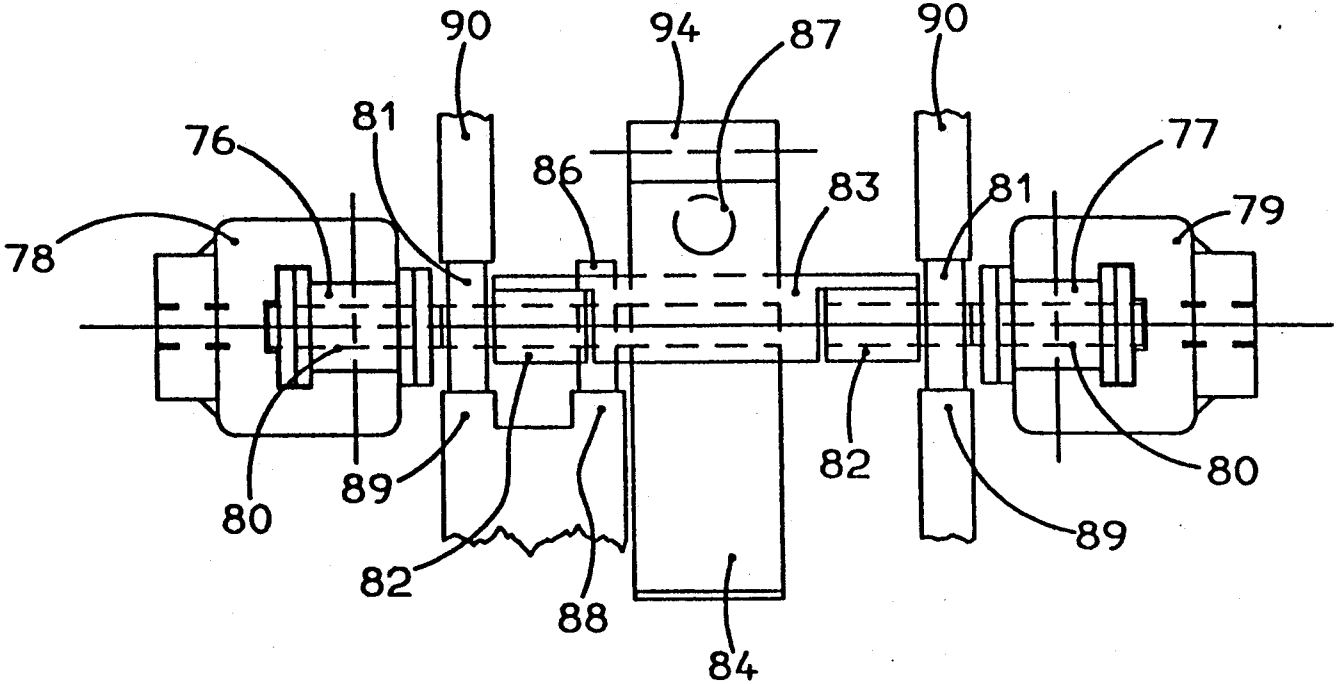
FIG. 23 is a detailed view illustrating the gripper system and transport chain in side view.
Figure 24:
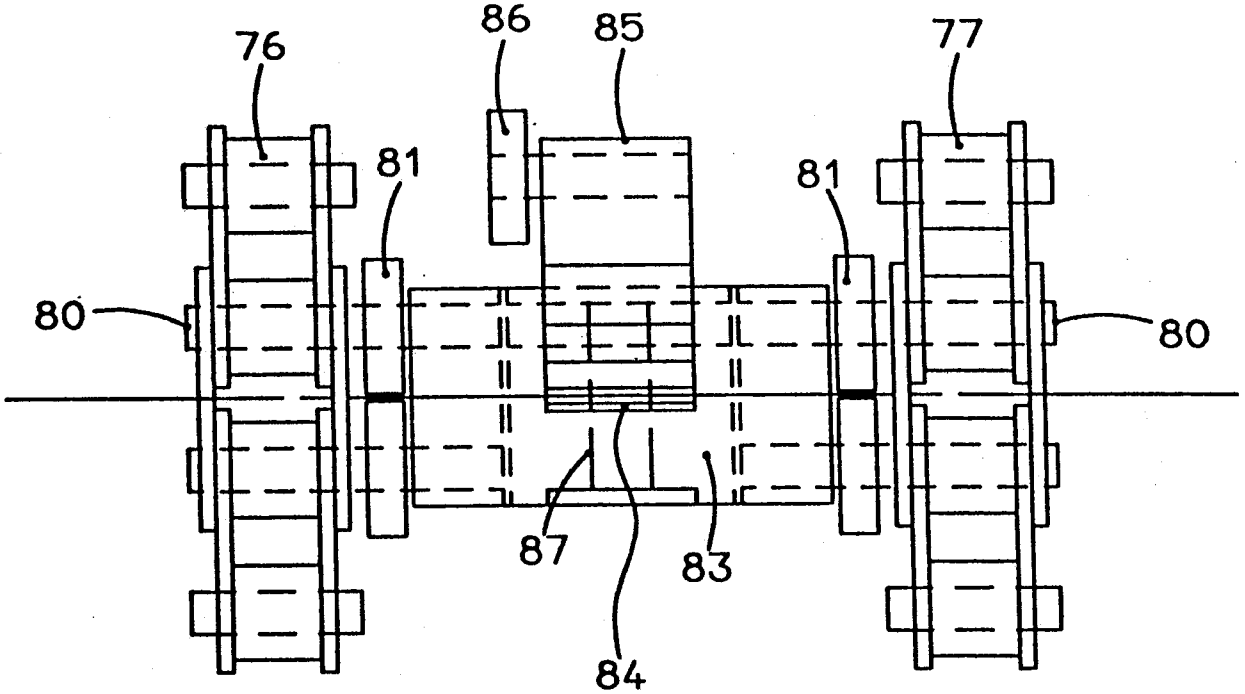
FIG. 24 is a schematic illustration of the gripper system and chain of FIG. 23 in top view.
Figure 27:
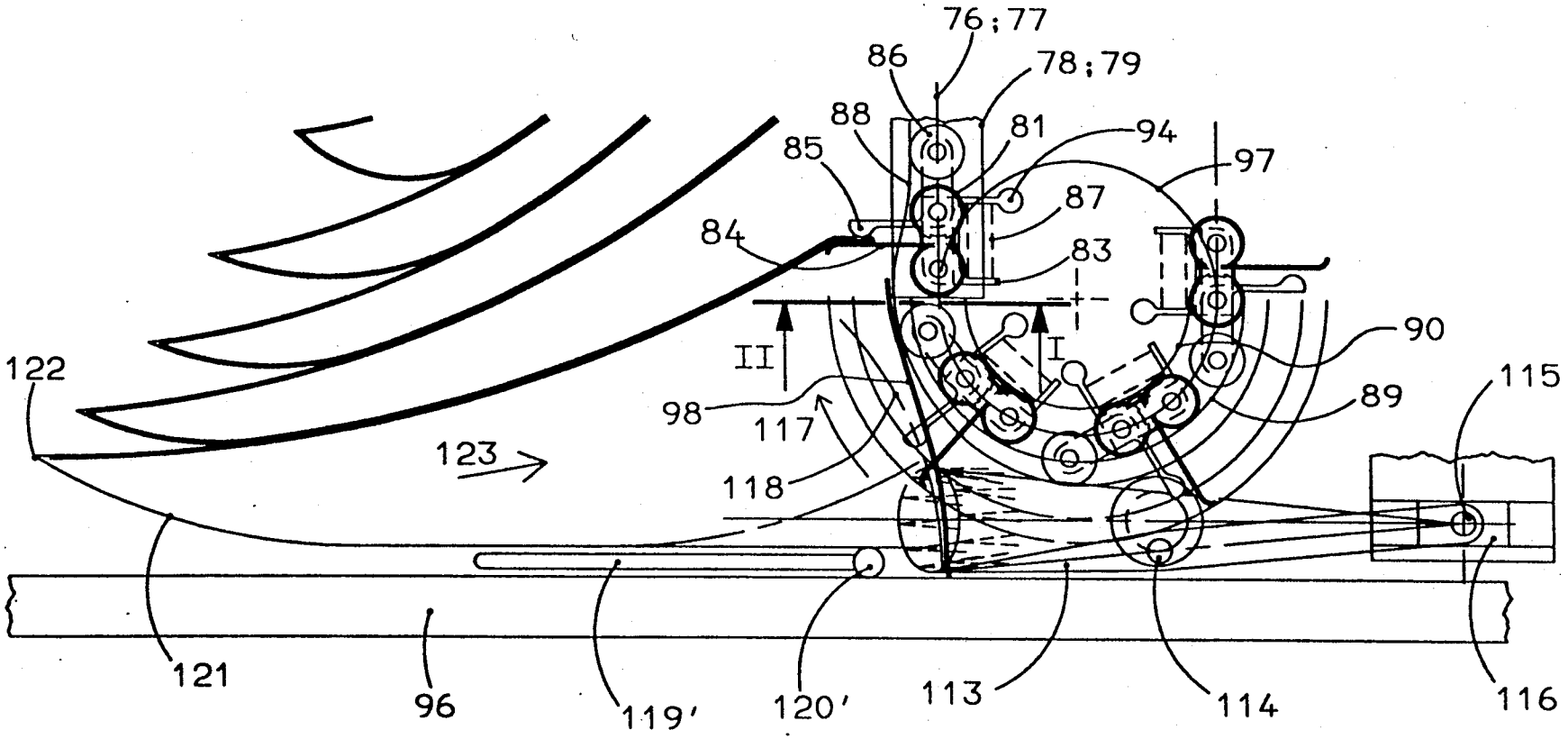
FIG. 27 is a detail view of the removal structure of FIG. 26 in side view.

Referring now to FIG. 19: The holding or cassette structure 27, in which the folded products 1, 2 are now retained, in interdigited form, is moved first in the direction of the arrow 61 (FIG. 19) and then in the direction of the arrow 74 into the position shown in FIG. 19, where it will be placed beneath a transport system 75 (FIG. 20). Transport system 75 includes a chain supplied with grippers or comprises parallel gripper chains. The transport system 75 is seen in detail in FIGS. 23, 24 and 27, in which FIG. 23 is a section along line I-II of FIG. 27, and FIG. 24 is a top view of FIG. 23.

The transport system 75 has two parallel gripper chains 76, 77 (FIGS. 23, 24) which, for example, are sprocket or roller chains, operating in guide tracks 78, 79. Bolts 80 extend from the chains and carry guide rollers 81 as well as carriers 82. Gripper carriers 83 are connected to the carriers 82, for example by being screwed thereon. Each one of the gripper carriers 83 has a gripper finger 84 securely connected thereto; a second gripper finger 85 (FIGS. 22, 24) is pivotably retained and can be controlled via an engagement roller 86 counter the force of a spring 87 engaged against the gripper carrier 83.

Figure 22:
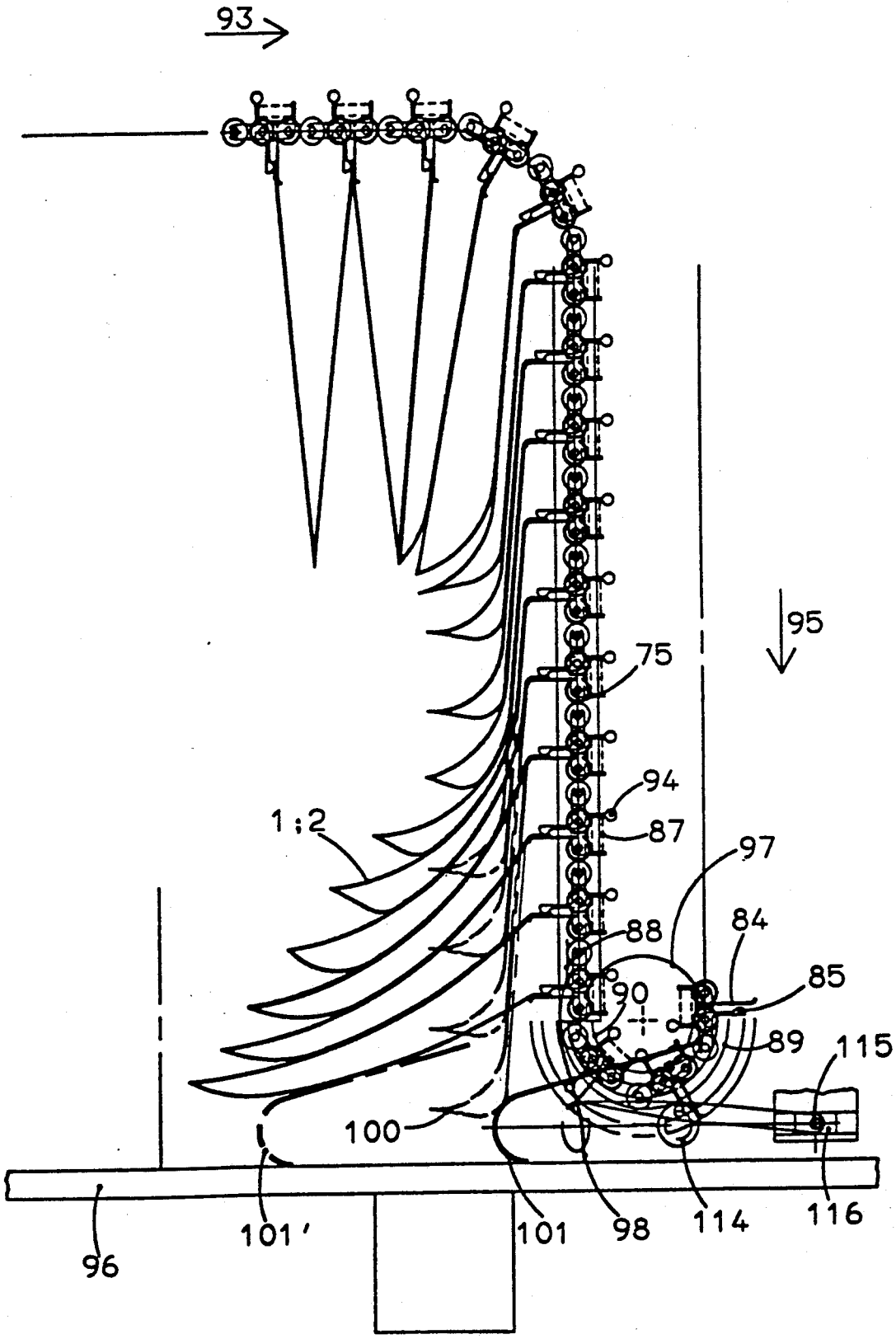
FIG. 22 illustrates stacking of the printed products in a vertical stack.

FIG. 22 shows that, when the roller 86 engages a cam track 88, the gripper finger 85 is moved or, rather, pivoted. If so, the roller chains 76, 77 engage the respective guide tracks 89, 90, via the guide rollers 81.

Carrier 27, with the carrier structures 23, is positioned beneath the transport system 75, as seen in FIG. 20 and, upon upward movement in direction of the arrow 74, the product or sheet portion of the leading product 2 is engaged centrally within a first open folded product 1. The product portion of the folded product 1 likewise is positioned centrally between the half product or product portion of the preceding folded product 2, which hangs on the transport system 75 and is inserted therein. Upon sequential supply of carriers 27 beneath the transport arrangement 75, see FIG. 20, a continuous sequence of dual-comb, interdigited folded products will be obtained. This permits stacking and removal from the stack without impact or jolts.

Figure 21:
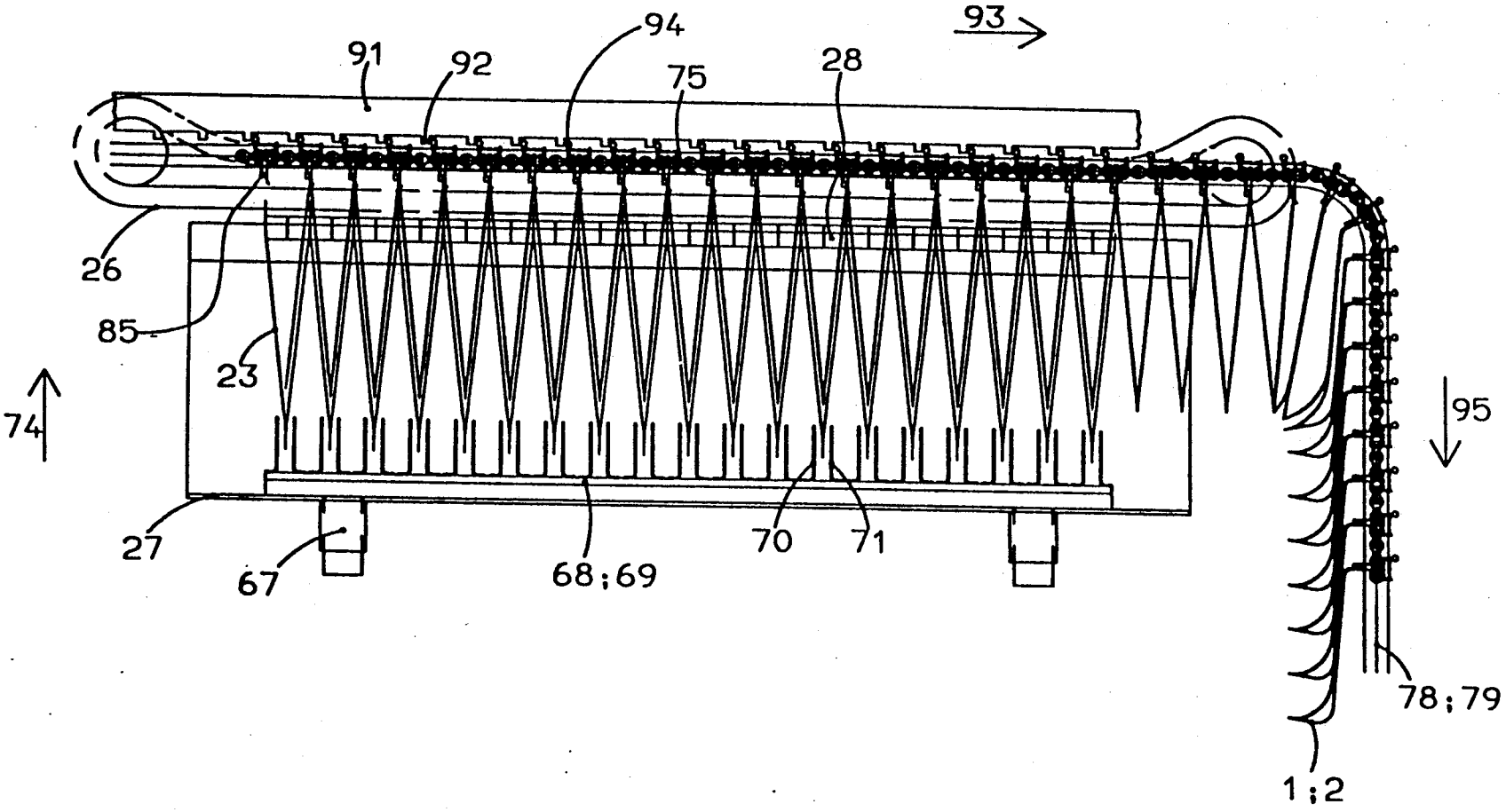
FIG. 21 illustrates the position of the printed products when gripped by the gripper system of FIG. 20.

FIG. 21 illustrates the upper position of the carrier 27, that is, directly beneath the transport system 75. A rail 91 with followers 92 is so dropped that, upon movement in the direction of arrow 93, all necessary gripper fingers 95 will engage the rear cam 94 to open for transfer of folded products thereto. The rail 91, after reception of the folded products in the grippers, then returns to the initial position shown in FIG. 20. The carrier 27, with the carrier structures 23, can be moved to the starting position shown in FIGS. 5 and 6 and, after withdrawal of the empty carrier structures 23 by means of drive 26, the entire system is ready for a new operating or working cycle.

Figure 25:
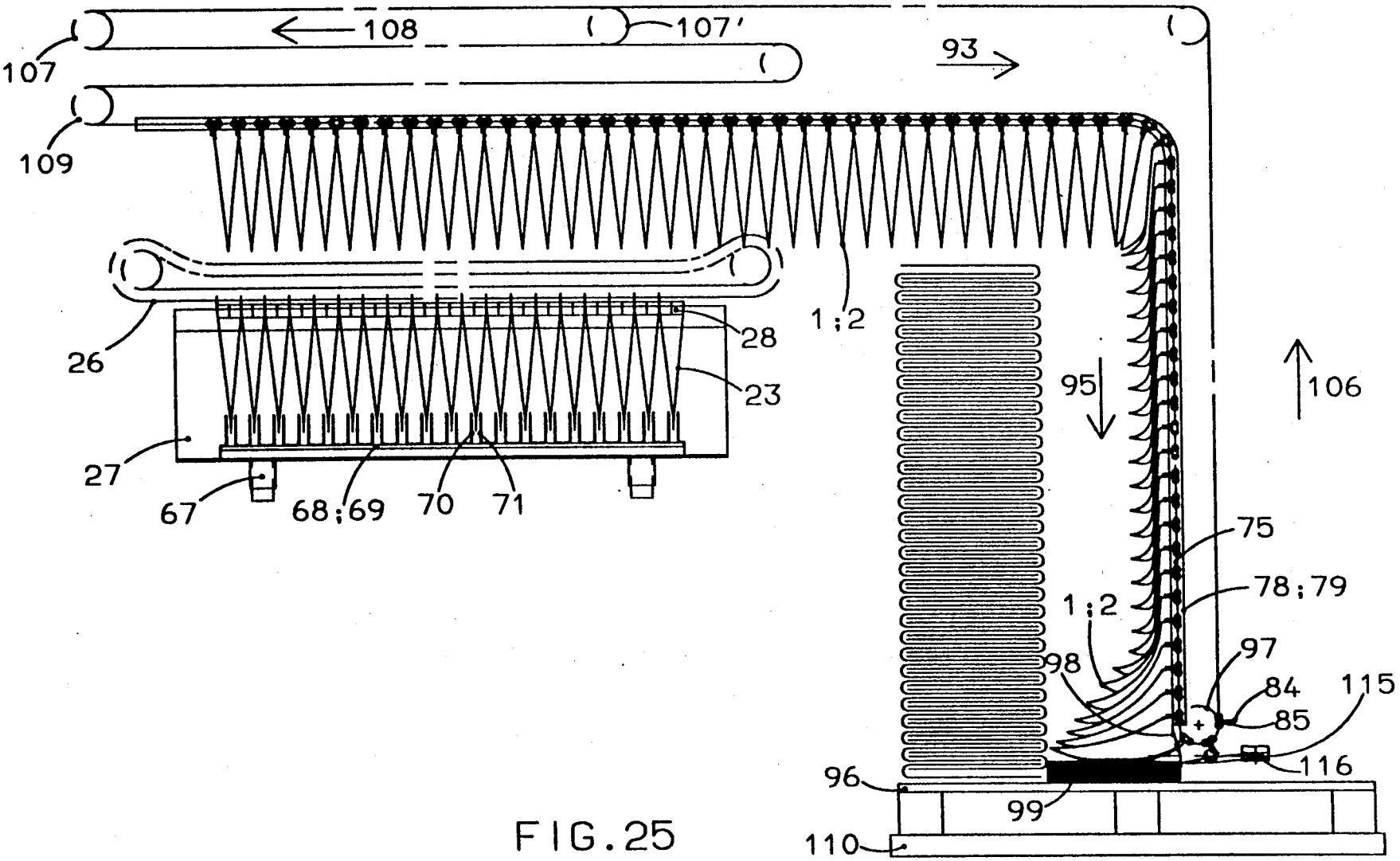
FIG. 25 shows the stack placed in position with the transport system ready to place another stack.

The gripper chain of the transport system 75 runs in the direction of the arrows 93, 95 (FIGS, 21, 22, 25 and 26) and, after transition of the chain into vertical direction, as shown by the arrow 95, by being guided over suitable rollers, the comb-like, interdigited folded products 1, 2 carried by the grippers 84, 85 can be stacked on a pallette 96 (FIG. 25). The illustration of FIG. 25 shows a stack in slightly expanded position, for ease of illustration, and start of a new stack 99 to the right of an already completed stack.

The folded products 1, 2 form a quasi endless zig-zag formed chain upon vertical stacking. The spring 87 holds the grippers 85, 84 closed, and the grippers are opened only in the region of the lower deflection wheel 97, about which the chains 76, 77 are passed. Cam track 88 opens the grippers 84, 85 and the therein retained folded products 1, 2 can be neatly stacked under assistance of a stripping sheet 98 to form the stack 99.

The very first sheet of a stack may not, initially, lay itself flat. To ensure that the first sheet will be flat, and not take on the position shown by the broken line 100, a positioning tongue 101 is pushed in the position shown in chain-dotted line at 101′ in FIG. 22 for positive guidance of the products at the start of stacking, by placement of the first product on the pallette in the appropriate position. The pallettes 96 are preferably placed on a stacking table 110 (FIG. 25). Alternatively, the products can be directly placed on a stacking table.

By suitable positioning of the transport system 75, the stacks 99 can be placed closely packed adjacent each other. To ensure closed packing, and as seen in FIG. 26, various sensors are provided to measure the position of the products, the height of the stack and the like.

Figure 26:
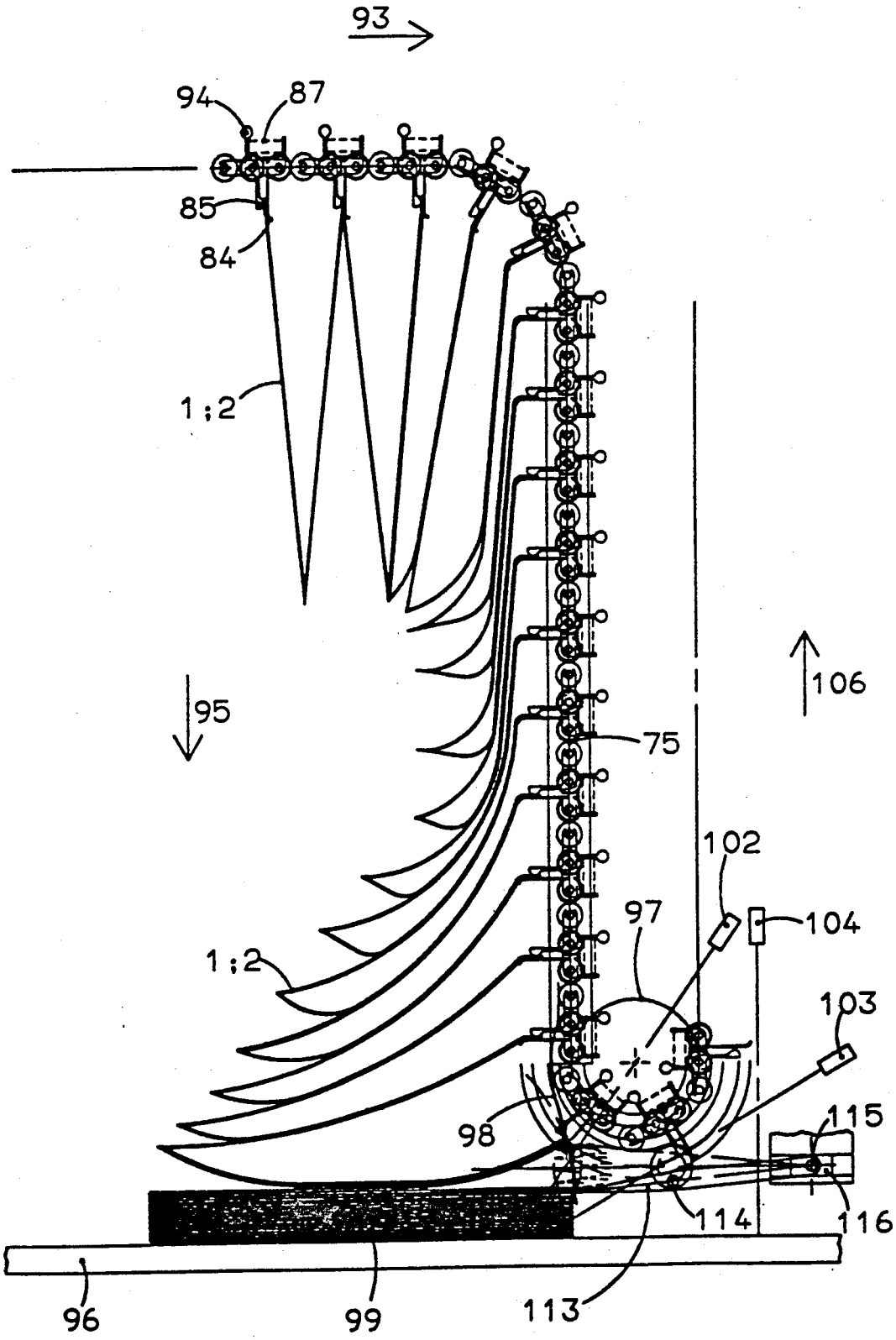
FIG. 26 illustrates detail of a removal system to remove folded products by the same, or different transport system which first generated the stack shown in FIG. 25.
Figure 28:
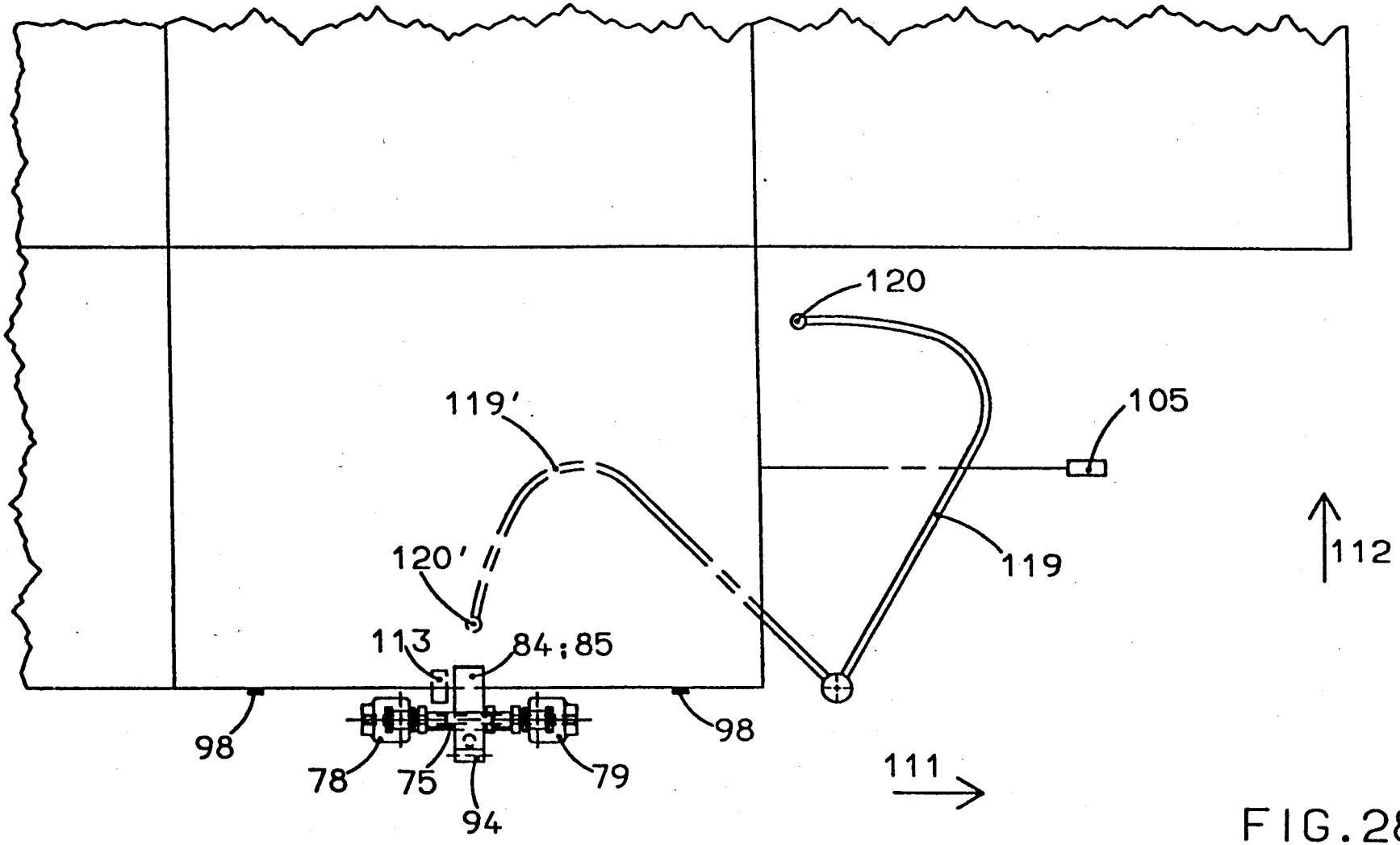
FIG. 28 is a schematic illustration of operating movements of removal elements under sensor control.

FIG. 26 illustrates a sensor 102 which scans the height of the stack; a sensor 103 measures the distance of the stack from a reference position. A sensor 104 determines the spacing to the pallette, and the sensor 105, see FIG. 28, measures and determines the position of the lateral edge of the stack. The respective measurements are transmitted in the form of control signals to a pallette drive, not shown, which controls the position of the lower deflection or guide wheel 97. The vertical position of guide or deflection wheel 97 for the chains is variable, and the wheel 97 can move in the direction of the arrow 106 (FIG. 26). The height or level of the deflection wheel 97 is changed as the stack height increases. To match the position of the wheel 97, the effective length of the chain must be controlled. FIG. 25 illustrates a chain length compensation system which is simple, using a deflection wheel 107 which, upon movement of the wheel 97 in the direction of the arrow 106, moves from an initial position 107' in the direction of the arrow 108. The transport system 75 is driven by a suitable power source coupled to a drive wheel, for example a sprocket wheel 109.

Measuring the stack on the pallette 96 generates signals representative of the height of the stack and determines the instant of time in which a stack has reached a predetermined height, at which time a next stack is to be started. The table 110 on which the pallette 96 is positioned can be furnished with an X-Y drive (not shown) and arranged in any suitable well known manner, to permit movement in the direction of the arrows 111, 112 (FIG. 28), respectively. This arrangement permits precise placement of the stack 99 on the pallette 96 and tight packing of the stacks thereon. Sensor 105 controls the lateral spacing from the edge of the pallette to the stack 99 so that the transport system 75 or, rather, the chains thereof, always run in the center of the stack.

The stack can be bundled and removed as such; alternatively, and in accordance with a feature of the invention, it can be disassembled and the printed products can be removed from the stack and returned, for example, again to carrier structures 23, for example for subsequent storage. For un-stacking, or removal of products from the stack, the operating sequences are essentially reversed.

In accordance with a feature of the invention, a crank drive 114 drives a pick-up element 113. The crank drive is driven in cadence with the operation of the chains 76, 77. One end is retained in a bearing bolt 115 which can slide in a longitudinal slide 116. The other end of the crank 113 of the crank drive is pointed and engages underneath the edge of the folded product, to lift it to the height of the grippers 84, 85. These grippers, in the lifted position, are open. A guide tongue 98 prevents excess overhang and provides for alignment. The gripper fingers 84, 85, preferably, have different lengths; the shorter fingers 85, looked at in the direction of rotation of the wheel 97, indicated by arrow 117, form the leading grippers and thus can run along past the edge of the respective folded products which, then, are lifted and engaged by the longer finger 84. As the wheel rotates, the finger 84 engages more and more under the respective product, so that the product engages deeply between the opened grippers 84, 85. The edge of the folded products travels in a path shown in FIG. 27 by the circle 118.

As illustrated in FIG. 7, the specific construction of the pick-up element 113 also permits engagement of the last half or portion of the folded product from the pallette surface. The sensor 104 continuously scans the surface of the pallette. As seen from the drawing, the first reception edge of a folded product, upon removal, is preferably a closed or folding edge, that is, the back of the folded products. This necessarily leaves the last half portion of the product open towards the front, as seen in FIG. 27. An engagement or lifting element 119 with a ball head 120 is moved in advance of the bend 121 of the lowermost half of a folded product and then to the positions 119', 120' in order to ensure reliable acceptance of even that last product portion; thereafter, the next stack can be separated.

The system permits fully automatic stacking and unstacking of printed products, which is a substantial advantage, particularly when handling newspapers. The comb or, rather, double-comb zig-zag interdigited placement of the folded products permits mutual support of the elements and, additionally, permits use of interrelated operating steps. The edges to be received for stacking, except for the first or last one, are always closed edges. The interdigited connection or interlinked connection upon accepting folded products by the grippers causes tension forces to arise acting in the direction of the arrows 123 (FIG. 27) due to the closed edges 122 opposite the gripped edge, which have the tendency to press the leading edge of the folded products against the tongue 98. This ensures precise and reliable stacking with a clean stacking corner on the pallette or other table and, reversely, upon unstacking, a reliable acceptance of the folded product by the grippers 84, 85 when the stack is to be reduced in height.

The basic principle of the invention can also be used with systems in which folded products are not interengaged or interlinked as described heretofore, although the interdigited, interlinked arrangement of the folded products is preferred and particularly space-saving. It is, of course, possible to place folded products with the edge upwardly and only grip those products, without interdigited products 1 therebetween. The system shown in connection with FIGS. 5–18 can also be used to associate folded products in interdigited, interlinked connection for other purposes than for vertical stacking; the chains for the vertical stack, described in connection with FIGS. 20–28 are a preferred system for a vertical stack; other arrangements are possible to remove the folded products, for example as placed in accordance with FIGS. 8–18, and associated description, for further handling thereof.

Various changes and modifications may be made, and any features described herein may be used with any of the others, within the scope of the inventive concept.

We claim:

1. The combination of individual folded products (1, 2), wherein the folded products define a back or fold line (5, 6) and two sheet portions (1*a*, 1*b*; 2*a*, 2*b*) joined at said back or fold line, said folded products being interdigited with the fold lines of successively alternate products facing in opposite first and second directions, whereby the fold line of any product will be between sheet portions of adjacent products at either side of said product having the respective fold line with apparatus to remove the individual interdigited folded products, particularly folded interdigited newspaper products, from a carrier structure (23) where the products are retained next to each other, and for stacking the products in an interdigited vertical stack, wherein said apparatus comprises transport means (75) located adjacent said carrier structure (23);

gripper means (84, 85) secured to the transport means and engageable about the fold lines facing in a first direction which is directed toward the gripper means, said fold lines defining first fold lines, said gripper means being further engageable against an adjacent part of the sheet portions joined at said first fold lines, to grip said first respective fold lines and adjacent partial sheet portions of the respective products;

said gripper means being further engageable with the sheet portions of alternate products positioned adjacent the partially gripped portions;

means (33, 34; 61, 74) for relatively moving said carrier structure and said transport means in a removal direction, which removes the gripped products, retained on the gripper means of the transport means, from the carrier structure (23);

means (78, 79) for guiding the transport means (75) in a vertical path (95);

means (96, 101, 101') for orienting the products in a horizontal direction to form an interdigited vertical stack of said individual products; and control means (88) operatively engageable with said gripper means (84, 85) for releasing the printed products from the gripper means as said products form said interdigited vertical stack.

2. The combination of claim 1, wherein said transport means (75) comprises transport chain means (76, 77);

said guide means (78, 79) guiding said transport chain means;

gripper carriers (83) transported on said chain means, said gripper carriers carrying said gripper means (84, 85);

wherein said gripper means includes at least one movable gripper finger (85) operatively associated with a second gripper finger (84); and spring means (87, 86) coupled to said at least one movable gripper finger (85) selectively, resiliently engaging said movable gripper finger against said second gripper finger to spring bias said movable gripper finger (85) for engagement against said second gripper finger (84).

3. The combination of claim 2, further including first gripper control means (91, 92) engageable with said spring means (87, 86) coupled to the at least one gripper finger for controlling said movable gripper finger to open or disengage from said second gripper finger (84), said first gripper control means being positioned with respect to the transport means (75) at a location opposite the carrier structure (23) to permit the movable gripper finger to engage about the fold lines and against the adjacent part of the sheet portions and, upon control operation of said first gripper control means, gripping said products by resilient engagement of the movable gripper finger (85) towards the second gripper finger (84) and, upon subsequent operation of said relative moving means (33, 34; 61, 74), separating said products from said carrier structure (23) and retain said products suspended on the transport means for subsequent orientation of the products in a horizontal direction to form the interdigited vertical stack.

4. The combination of claim 2, further including a guide wheel (97) rotating about an essentially horizontal axis, and positionable along said vertical path (95), said guide wheel (97) guiding said transport means (75) thereabout, with the gripper means (84, 85) projecting radially outwardly from the transport means as it is guided about said guide wheel; and wherein said control means (88) includes second gripper control means (88) controlling said movable gripper finger (85) counter the pressure of the biassing spring means (87) into disengaged position to release gripped products as the transport means passes around the guide wheel.

5. The combination of claim 4, including support means (96, 110) for said vertical stack, said guide wheel and said support means being relatively postionable to form said vertical stack upon release of the movable gripper finger;

product stripping means (98) being positioned in the vicinity of said guide wheel (97) and assisting in stripping products from between said gripper fingers (84, 85) upon opening of the movable gripper finger; and a product aligning element (101) movable above said support means between a projected position (FIG. 22: 101') and a withdrawn position (101) for straightening products supplied by said gripper means on the transport means as they approach, and are placed on the support means.

6. The combination of claim 4, wherein said guide wheel (97) is vertically movable as the stack increases in height upon supply of interdigited products thereto;

wherein said transport means comprises and elongated element of predetermined length; and wherein length and position compensating means (107, 109) are provided, coupled to said transport means of finite length for compensating for the relative positioning of said transport means with respect to the carrier structure (23) when the guide wheel is shifted along the growing stack.

7. The combination of claim 1, further including sensor means (102–105) positioned for sensing at least one of:

the height of said stack (99);

the position of said transport means (75) with respect to an existing stack;

and a movable support means (96, 110) movable in a horizontal plane in rectangular coordinate (X-Y) directions under control of control signals derived from said sensor means.

8. The combination of claim 4, further including separating means (113, 116) movable with said guide wheel (97), and engageable between adjacent products on said stack (FIG. 26: 99), to permit gripping of said separated products by said gripper means (84, 85) for unstacking and removing products from said stack, said separating means comprising reciprocating means, operating in cadence with transporting movement of said transport means and engageable between adjacent products and additionally carrying out a vertical movement over a limited distance for separating adjacent products.

said second gripper control means (88) controlling the movable gripper finger (85) to open position as said products are being separated and closing upon the uppermost product as the transport means passes about the guide wheel (97), to lift the uppermost product off the stack and thus unstack the products therefrom and replace the products from the stack on the transport means.

9. The combination of claim 8, further including terminal sheet portion positioning means (FIGS. 27, 28:

119-121) for assuring retention between said gripper means (84, 85) of a terminal sheet portion, said terminal sheet portion positioning means comprising a movable insert element (119) engageable beneath a terminal sheet portion and lifting said terminal sheet portion to ensure gripping of said terminal sheet portion by said gripper means as the gripper means moves about the guide wheel (97).

10. The combination of claim 1, further including carrier means (27) supporting a plurality of carrier structures (23) thereon, said carrier structures (23) being placed on said carrier means in zig-zag connected form;

product separating means (28) being positioned on said carrier structures for retaining products within said carrier structure in open V-shaped formation; and positioning means (26) coupled to the carrier structures (23) for placing the carrier structures in expanded zig-zag position and permitting said product separating means (28) to hold alternate products in open V-shaped position between said carrier structures while permitting placement of folded products over edges of said carrier structures interdigited with the alternate structures in open V-shaped position, and for subsequent transfer to the gripper means (84, 85) of said transport means (75).

11. The combination of claim 1 with means for positioning the folded products on the carrier structure in said interdigited form adjacent said transport means (75), said positioning means comprising a first carrier means (27') retaining first carrier structure (23');

second carrier means (27) retaining second carrier structure (23);

first and second clamping strips or rails (35, 35'), each of said clamping strips or rails including product grippers (40, 41);

means for controlling the first clamping strip (35') with said product grippers (40, 41) in open position then to close the product grippers, and for guiding said first clamping strip or rail (35') with products gripped adjacent free edges by said product grippers (40, 41) above the second clamping strip or rail (35);

means for controlling the product grippers (40, 41) on the second clamping strip (35) at the opposite ends thereof;

means for guiding both said first and second clamping strips or rails (35, 35') in a semicircular rotary path about an axis of rotation parallel to said clamping strips or rails whereby the products held between said clamping strips or rails will be inverted by 180° about a common center;

means for controlling the product grippers (40, 41) on the first clamping strip or rail to release the free ends thereof, and means for moving the second clamping strip or rail (35) to place the free ends of the products retained thereon over said carrier structures (23) in said second second carrier means (27).

12. The combination of claim 11, wherein said first and second carrier structures (23, 23') are two-part structures;

and drive means (30, 30', 31, 31') engageable with said two-part carrier structures for laterally separating said two parts of the carrier structures from each other.

13. The combination of claim 11, comprising a lower holding or clamping strip or rail including holding product grippers (70, 71), said holding clamping strip or rail being located beneath said carrier structures (23) for gripping products on said carrier structures to permit lateral removal of said carrier structures from the products thereon while retaining said products in position.

14. The combination of claim 11, further including at least semi-circular guide means (62) for guiding said clamping strips or rails (35, 35'), said semi-circular guide means including a diagonally extending guide path to permit reverse movement of at lest one of said clamping strips or rails (35) after the products held between both said clamping strips or rails have been rotated by 180°.

15. The combination of claim 14, wherein, after release of products from said product grippers (40, 41) on that one (35') of the clamping strips or rails (35, 35') which was rotated by 180°, said one clamping strip or rail is placed in its initial position and first guided about the semicircular guide means and then through the diagonal path for return to the initial position (FIG. 7) ready for acceptance of further products from further first carrier structures (23') in a further carrier means (27').

16. The combination of claim 11, further including operating rail elements (38, 39) guided on said clamping strips or rails (35, 35'), said operating rail element controlling the position of the product grippers (40, 41; 40', 41') with respect to each other;

stationary piston-cylinder means (48) engageable with said operating rail elements (38, 39) when said clamping strips or rails are in a predetermined relative position with respect to said piston-cylinder means (48);

and spring means (43) engageable with said operating rail elements for retaining the product grippers (40, 41; 40', 41') in clamping and gripping position unless moved counter said clamping or gripping position by said piston-cylinder means.

17. The combination of claim 16, including a common operating lever (42) engageable with said operating rail elements (38, 39), said piston cylinder means acting on said pivot lever (42);

a latch (49) coupled to a respective one of said clamping strips or rails (35, 35') for holding said lever in a predetermined position;

and a second fixed piston-cylinder means (50) in predetermined position with respect to said latch for unlatching the latch.

18. A method of removing folded products (1, 2), particularly folded newspaper products, from a carrier structure (23), wherein the folded products are located on the carrier structure in V formation defining a back or fold line (5, 6) and two sheet portions (1*a*, 1*b*; 2*a*, 2*b*) joined at said back or fold line;

said folded products being interdigited with the fold lines of successively alternate first and second products facing in opposite first and second directions, comprising the steps of orienting said folded products such that the fold lines of alternate products (2) face upwardly;

gripping said upwardly facing fold lines (6) of the second product (2) and adjacent regions of the sheet portions of first products (1) adjacent the fold lines (6) of the second product (2), raising said thus gripped first and second interdigited products from the carrier structure, and transporting said products in a vertical path; and orienting the products (1, 2) in a horizontal direction and placing the products on a support surfacing (96, 110), said products thereby forming a vertical stack in which the fold lines (5, 6) of alternate products (1, 2) are at respectively opposite direction whereby said stack will be stable.

19. The method of claim 18, wherein said step of orienting the products in a horizontal direction comprises transporting said products by a transport chain (75) having relatively movable grippers (84, 85) thereon, first in said vertical path and then about a deflection or guide wheel (97); and controlling the grippers to release as they pass about the circumference of the deflection or guide wheel (97), to thereby remove the grippers from the folded products as they move about the deflection or guide wheel and release said products.

20. The method of claim 19, including the step of sensing the height of the resulting stack;

and moving the deflection or guide wheel (97) upwardly as a function of stack height to always place products carried on the grippers above the uppermost product which had just been released from the preceding grippers passing about the deflection wheel.

21. The method of claim 18, including the step of assembling the products in interdigited position, said assembling step comprising supplying first and second products (1, 2) in open V-shaped position with the fold lines (5) of the first and second products (1, 2) facing downwardly;

in one step, gripping the second products (2) at the open edges of the respective sheet portions (2*a*, 2*b*) thereof;

in a second step, gripping the fold lines (6) of the second one of said products;

inverting said thus twice gripped second products (2);

placing said inverted thus twice gripped second products over the first products (1) and releasing the grip of at least said one gripping step to form said interdigited folded products of successively alternate products facing in opposite first and second directions;

gripping the first products (1) at the fold lines (5) to permit release of said first products (1) from said carrier structure (23);

then carrying out said step of gripping said now upwardly facing fold lines (6) of the second products (2) and adjacent regions of the sheet portions of the first product (1) to grip the second products with the first products interdigited therebetween, and removing the gripped second and first products from the carrier structure (23) by carrying out said raising step.

* * * * *